US010768543B2

(12) United States Patent
Tsujimoto et al.

(10) Patent No.: US 10,768,543 B2
(45) Date of Patent: Sep. 8, 2020

(54) TONER

(71) Applicant: CANON KABUSHIKI KAISHA, Tokyo (JP)

(72) Inventors: Daisuke Tsujimoto, Tokyo (JP); Toru Takahashi, Toride (JP); Hiroki Watanabe, Matsudo (JP); Yoshihiro Ogawa, Toride (JP); Wakashi Iida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/550,418

(22) Filed: Aug. 26, 2019

(65) Prior Publication Data

US 2020/0073265 A1 Mar. 5, 2020

(30) Foreign Application Priority Data

Aug. 28, 2018 (JP) ..... 2018-159407

(51) Int. Cl.
*G03G 9/08* (2006.01)
*G03G 9/097* (2006.01)
*G03G 9/087* (2006.01)

(52) U.S. Cl.
CPC ..... *G03G 9/09716* (2013.01); *G03G 9/0819* (2013.01); *G03G 9/08755* (2013.01); *G03G 9/09708* (2013.01)

(58) Field of Classification Search
CPC ..... G03G 9/09708; G03G 9/09716; G03G 9/08755
USPC ..... 430/109.4, 108.6
See application file for complete search history.

(56) References Cited

U.S. PATENT DOCUMENTS 5,437,949 A 8/1995 Kanbayashi et al.
5,607,806 A 3/1997 Kanbayashi et al.
5,635,326 A 6/1997 Kanbayashi et al.
5,670,288 A 9/1997 Okado et al.
5,700,617 A 12/1997 Takiguchi et al.
5,747,209 A 5/1998 Takiguchi et al.
5,750,302 A 5/1998 Ogawa et al.
5,851,714 A 12/1998 Taya et al.
5,858,593 A 1/1999 Tamura et al.
5,912,099 A 6/1999 Kanbayashi et al.
5,922,500 A 7/1999 Iida et al.
5,976,752 A 11/1999 Matsunaga et al.
5,994,018 A 11/1999 Iida et al.
6,013,402 A 1/2000 Kanbayashi et al.
6,022,659 A 2/2000 Kanbayashi et al.
6,060,202 A 5/2000 Ogawa et al.
6,077,635 A 6/2000 Okado et al.
6,238,834 B1 5/2001 Tamura et al.
6,326,114 B1 12/2001 Itakura et al.
6,426,169 B1 7/2002 Onuma et al.
6,485,875 B1 11/2002 Karaki et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,875,549 B2 4/2005 Yamazaki et al.
6,881,527 B2 4/2005 Moribe et al.
7,115,349 B2 10/2006 Iida et al.
7,147,980 B2 12/2006 Itakura et al.
7,238,387 B2 7/2007 Ogawa et al.
7,267,919 B2 9/2007 Moribe et al.
7,368,211 B2 5/2008 Hasegawa et al.
7,402,368 B2 7/2008 Ogawa et al.
7,422,832 B2 9/2008 Ogawa et al.
7,455,947 B2 11/2008 Ida et al.
7,470,494 B2 12/2008 Nishiyama et al.
7,544,457 B2 6/2009 Hashimoto et al.
7,582,401 B2 9/2009 Ogawa et al.
7,678,524 B2 3/2010 Hasegawa et al.
7,704,659 B2 4/2010 Ogawa et al.
7,811,734 B2 10/2010 Ogawa et al.
7,816,063 B2 10/2010 Hashimoto et al.
7,939,231 B2 5/2011 Ogawa et al.
8,084,174 B2 12/2011 Hasegawa et al.
8,124,306 B2 2/2012 Hirata et al.
8,501,377 B2 8/2013 Takahashi et al.
8,512,925 B2 8/2013 Moribe et al.
9,097,998 B2 8/2015 Yamazaki et al.
9,128,400 B2 9/2015 Takahashi et al.
9,158,217 B2 10/2015 Takahashi et al.
9,454,094 B2 9/2016 Tsujimoto et al.
9,500,975 B2 11/2016 Sugahara et al.
9,599,920 B2 3/2017 Sugahara et al.
9,606,466 B2 3/2017 Takahashi et al.
9,703,216 B2 7/2017 Tsuchida et al.
9,778,598 B2 10/2017 Onozaki et al.
9,785,070 B2 10/2017 Sugahara et al.
9,958,809 B2 5/2018 Sugahara et al.

(Continued)

FOREIGN PATENT DOCUMENTS

JP 2007-058135 3/2007
JP 2009-014820 1/2009

OTHER PUBLICATIONS

U.S. Appl. No. 16/526,501, Nobuyoshi Sugahara, filed Jul. 30, 2019.

(Continued)

*Primary Examiner* — Mark A Chapman
(74) *Attorney, Agent, or Firm* — Venable LLP

(57) ABSTRACT

A toner having a toner particle, which contains a binder resin, and inorganic fine particles, the toner being characterized in that the binder resin contains a polyester resin, the polyester resin has, at a terminal, an alkyl group having an average number of carbon atoms of from 4 to 102, the number average particle diameter of primary particles of the inorganic fine particles is from 10 to 90 nm, the dielectric constant of the inorganic fine particles is from 55.0 to 100.0 pF/m, as measured at 25° C. and 1 MHz, and the inorganic fine particles are surface-treated with an alkylalkoxysilane represented by formula (1) below:

$$C_nH_{2n+1}—Si(—OC_mH_{2m+1})_3 \quad (1)$$

in formula (1), n denotes an integer of from 4 to 20, and m denotes an integer of from 1 to 3.

5 Claims, No Drawings

(56) References Cited

U.S. PATENT DOCUMENTS

| | | | |
|---|---|---|---|
| 10,007,206 | B2 | 6/2018 | Sugahara et al. |
| 10,409,188 | B2 | 9/2019 | Sugahara et al. |
| 10,451,985 | B2 | 10/2019 | Takahashi et al. |
| 2002/0055053 | A1 | 5/2002 | Kasuya et al. |
| 2004/0110076 | A1 | 6/2004 | Yamazaki et al. |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2019/0155182 | A1 | 5/2019 | Watanabe et al. |

OTHER PUBLICATIONS

U.S. Appl. No. 16/531,306, Ryuichiro Matsuo, filed Aug. 5, 2019.
U.S. Appl. No. 16/550,452, Takeshi Ohtsu, filed Aug. 26 2019.
U.S. Appl. No. 16/571,427, Nobuyoshi Sugahara, filed Sep. 16, 2019.
U.S. Appl. No. 16/707,540, Toru Takahashi, filed Dec. 9, 2019.

TONER

BACKGROUND OF THE INVENTION

Field of the Invention

The present invention relates to an image-forming method for visualizing an electrophotograph or electrostatic image; a toner used in toner jet systems; and a method for producing the toner.

Description of the Related Art

As image-forming methods using electrophotographic systems involving the use of dry toners have increased in terms of speed and image quality in recent years, and these methods are not limited to office applications, and are now used in a wide variety of other applications. An example of these applications is the print on demand (POD) field, and use has been investigated in bookmaking applications using a variety of media and packaging applications such as package printing.

In order to achieve high productivity in the POD field, toners require better low-temperature fixability than in the past.

Japanese Patent Application Publication No. 2007-58135 discloses a binder resin for a toner, which contains a polyester resin having a low softening point, which is obtained by condensation polymerization of raw material monomers including a monovalent long chain aliphatic compound. This type of binder resin enables plasticization of the binder resin due to the monovalent long chain aliphatic compound, which binds to a polyester.

In addition, Japanese Patent Application Publication No. 2009-14820 discloses a polyester resin that contains, as a constituent unit, a long chain alkyl group having 30 or more carbon atoms and having a specific functional group. This type of binder resin improves the dispersibility of a wax in a toner due to the long chain alkyl group, which binds to a polyester.

SUMMARY OF THE INVENTION

However, if media on which toners are difficult to fix, such as coated papers, are used in bookmaking or package printing, a printed toner can detach and cause image defects as a result of strong external stresses such as contact with fingernails, sharp objects, and the like. So-called scratch abrasion can also occur.

As means for solving such problems, a means such as lowering the processing speed so as to sufficiently melt the toner and firmly fix the toner to the media has been employed in cases where printing is carried out on media such as coated paper.

However, high productivity is required in the POD field, and it is essential to achieve higher speeds on a variety of media.

In addition, investigations relating to scratch abrasion are not carried out in Japanese Patent Application Publication Nos. 2007-58135 and 2009-14820. Therefore, when using media on which toners are difficult to fix, such as coated papers, a fixed toner image breaks and detaches if a strong external stress is applied to the media.

Therefore, when using media on which toners are difficult to fix, such as coated papers, there is still the problem of preventing scratch abrasion in cases where a strong external stress is applied to the media.

One aspect of the present invention is directed to providing a toner which does not undergo scratch abrasion when used on media on which toners are difficult to fix, such as coated papers, even if a strong external stress is applied to the media, exhibits excellent hot offset resistance, half tone uniformity and image density, which are required in the POD field, and suppresses the occurrence of fogging.

One aspect of the present invention provides:

A toner having a toner particle, which contains a binder resin, and inorganic fine particles, the toner being characterized in that the binder resin contains a polyester resin, the polyester resin has, at a terminal, an alkyl group having an average number of carbon atoms of from 4 to 102, a number average particle diameter of primary particles of the inorganic fine particles is from 10 to 90 nm, a dielectric constant of the inorganic fine particles is from 55.0 to 100.0 pF/m, as measured at 25° C. and 1 MHz, and the inorganic fine particles are surface-treated with an alkylalkoxysilane represented by formula (1) below.

$$C_nH_{2n+1}—Si(—OC_mH_{2m+1})_3 \quad (1)$$

In formula (1), n denotes an integer of from 4 to 20, and m denotes an integer of from 1 to 3.

According to one aspect of the present invention, it is possible to provide a toner which does not undergo scratch abrasion when used on media on which toners are difficult to fix, such as coated papers, even if a strong external stress is applied to the media, exhibits excellent hot offset resistance, half tone uniformity and image density, which are required in the POD field, and suppresses the occurrence of fogging.

Further features of the present invention will become apparent from the following description of exemplary embodiments.

DESCRIPTION OF THE EMBODIMENTS

In the present invention, the terms "from XX to YY" and "XX to YY", which indicate numerical ranges, mean numerical ranges that include the lower limits and upper limits that are the end points of the ranges, unless otherwise indicated.

One aspect of the present invention relates to:

A toner having a toner particle, which contains a binder resin, and inorganic fine particles, the toner being characterized in that the binder resin contains a polyester resin, the polyester resin has, at a terminal, an alkyl group having an average number of carbon atoms of from 4 to 102, a number average particle diameter of primary particles of the inorganic fine particles is from 10 to 90 nm, a dielectric constant of the inorganic fine particles is from 55.0 to 100.0 pF/m, as measured at 25° C. and 1 MHz, and the inorganic fine particles are surface-treated with an alkylalkoxysilane represented by formula (1) below.

$$C_nH_{2n+1}—Si(—OC_mH_{2m+1})_3 \quad (1)$$

In formula (1), n denotes an integer of from 4 to 20, and m denotes an integer of from 1 to 3.

According to investigations by the inventors of the present invention, by using the toner mentioned above, it is possible to provide a toner which does not undergo scratch abrasion when used on media on which toners are difficult to fix, such as coated papers, even if a strong external stress is applied to the media, exhibits excellent hot offset resistance, half tone uniformity and image density, which are required in the POD field, and suppresses the occurrence of fogging.

The reason why an advantageous effect that was previously unobtainable can be achieved by the configuration mentioned above is thought to be as follows.

As a result of diligent research, the inventors of the present invention understood that scratch abrasion is caused by an external additive present at interfaces of fixed toner particles.

The external additive is essential for improving toner particle fluidity and controlling charge quantity in order to achieve higher image quality. However, external additives are often inorganic substances such as silica fine particles or titanium oxide fine particles, which are not melted by heat at the time of fixing. Therefore, when external stress is applied to a fixed image, the fixed toner image may break and detach as a result of the external additive present at interfaces between fixed toner particles.

The dielectric constant of the inorganic fine particles is from 55.0 to 100.0 pF/m, as measured at 25° C. and 1 MHz. In addition, the dielectric constant is preferably from 60.0 to 85.0 pF/m, and more preferably from 65.0 to 80.0 pF/m.

If the dielectric constant range falls within the range mentioned, the inorganic fine particles readily polarize and achieve the advantageous effect of attracting other dielectric materials. Here, dielectric materials are substances that are dielectric rather than electrically conductive, and have the property of being electrically polarized when subjected to an external electric field.

Dielectric materials having such a property exhibit the effect of being mutually attracted to each other, and substances having high dielectric constants, such as these inorganic fine particles, are superior in terms of the advantageous effect of attracting other dielectric materials.

In cases where the dielectric constant is less than 55.0 pF/m, the power of attracting a dielectric material is insufficient and the advantageous effect of the present invention cannot be achieved.

However, in cases where the dielectric constant exceeds 100.0 pF/m, the power of attracting inorganic fine particles to each other increases, aggregation readily occurs and the power of attracting other dielectric materials weakens, meaning that the advantageous effect of the present invention cannot be achieved.

The dielectric constant can be controlled by altering the particle diameter or crystal structure of the inorganic fine particles or the method for producing the inorganic fine particles.

The toner particle contains a polyester resin.

The polyester resin is a dielectric material due to the ester bond moiety polarizing.

Therefore, in the toner particle, the inorganic fine particles, which are an external additive, are strongly attracted to the polyester resin contained in the binder resin. Therefore, at the time of fixing, inorganic fine particles present between toner particles can strongly attract adjacent toner particles to each other.

The inorganic fine particles are surface-treated with an alkylalkoxysilane represented by formula (1) below.

In addition, the polyester resin has, at a terminal, an alkyl group having an average number of carbon atoms of from 4 to 102.

Therefore, the inorganic fine particles and the polyester resin are present in a strongly attracted state at the time of fixing, and alkyl groups present at the surface of the inorganic fine particles and alkyl groups present at terminals of the polyester resin can strongly interact with each other. As a result, toner particles are strongly bonded to each other at the time of fixing, and even if a strong external stress is applied, the toner does not detach and does not cause image defects.

In cases where the average number of carbon atoms in alkyl groups at terminals of the polyester resin is less than 4, the alkyl groups are too short and interactions with alkyl groups at the surface of the inorganic fine particles are unlikely to occur.

However, in cases where the average number of carbon atoms exceeds 102, the alkyl groups are too long, the function of the alkyl groups in the toner particle is limited, the alkyl groups are unlikely to be present near alkyl groups at the surface of the inorganic fine particles, and interactions are insufficient.

The average number of carbon atoms in alkyl groups at terminals of the polyester resin is preferably from 32 to 80, and more preferably from 34 to 60.

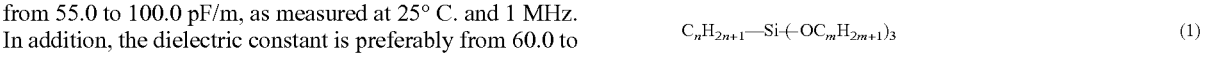

$$C_nH_{2n+1}—Si(—OC_mH_{2m+1})_3 \quad (1)$$

In formula (1), n denotes an integer of from 4 to 20, and m denotes an integer of from 1 to 3.

In cases where the value of n is less than 4, alkyl groups at inorganic fine particle surfaces are too short and interactions with alkyl groups in the polyester resin are unlikely to occur.

However, in cases where the value of n exceeds 20, alkyl groups at the surface of the inorganic fine particles are too long, and attractions between the parent inorganic fine particles and the polyester resin are weakened. Therefore, interactions between alkyl groups at terminals of the polyester resin and alkyl groups at the surface of the inorganic fine particles are unlikely to occur. In addition, the value of n is preferably from 4 to 10.

In cases where the value of m is greater than 3, reactivity decreases and it is not possible to adequately introduce alkyl groups at the surface of the inorganic fine particles.

In addition, the alkylalkoxysilane is a trialkoxysilane.

In the case of a trialkoxysilane, bonding to the parent inorganic fine particles becomes stronger, and strong interactions occur between alkyl groups present at the surface of the inorganic fine particles and alkyl groups present at terminals of the polyester resin.

Examples of the alkylalkoxysilane include isobutyltrimethoxysilane, isobutyltriethoxysilane, pentyltrimethoxysilane, pentyltriethoxysilane, hexyltrimethoxysilane, hexyltriethoxysilane, n-octyltrimethoxysilane, n-octyltriethoxysilane, decyltrimethoxysilane, decyltriethoxysilane, dodecyltrimethoxysilane, dodecyltriethoxysilane, hexadecyltrimethoxysilane, hexadecyltriethoxysilane, octadecyltrimethoxysilane and octadecyltriethoxysilane.

In addition, the surface treatment amount by the alkylalkoxysilane is preferably from 1 to 60 parts by mass, more preferably from 3 to 20 parts by mass, and further preferably from 5 to 12 parts by mass, relative to 100 parts by mass of the inorganic fine particles.

If the surface treatment amount falls within the range mentioned above, it is possible to uniformly introduce alkyl groups at the surface of the inorganic fine particles, and inorganic fine particles present between toner particles further improve the function of causing toner particles to be strongly attracted to each other.

Surface treatment of the inorganic fine particles by the alkylalkoxysilane is not particularly limited as long as an ordinary publicly known treatment is used.

Examples of the surface treatment include methods comprising dispersing the inorganic fine particles in a solution obtained by dissolving the alkylalkoxysilane in an organic solvent, then removing the solvent by filtration or spray drying, and then curing by means of heating;

dry treatment methods such as methods comprising use of a fluidized bed apparatus to spray coat the inorganic fine particles with a solution obtained by dissolving the alkylalkoxysilane in an organic solvent, and then removing the solvent by heating and drying so as to cure a film; and wet treatment methods comprising surface treating the inorganic fine particles with the alkylalkoxysilane in an aqueous medium, then neutralizing with an alkali, filtering, washing, drying and deagglomerating.

The inorganic fine particles may, if necessary, be surface treated with another treatment agent in addition to the surface treatment by the alkylalkoxysilane. A fluorine-containing alkoxysilane is preferred as the other treatment agent. In addition, a surface treatment may be carried out using a variety of treatment agents, such as functional group-containing silane compounds, other organosilicon compounds, unmodified silicone varnishes, a variety of modified silicone varnishes, unmodified silicone oils and a variety of modified silicone oils, as this other treatment agent.

The number average particle diameter of primary particles of the inorganic fine particles is from 10 to 90 nm. This number average particle diameter of primary particles is preferably from 11 to 75 nm, and more preferably from 25 to 70 nm.

If the number average particle diameter of primary particles of the inorganic fine particles falls within the range mentioned above, the inorganic fine particles can effectively interact between toner particles.

In cases where the number average particle diameter of primary particles of the inorganic fine particles is greater than 90 nm, even if the inorganic fine particles and the polyester resin are strongly attracted to each other, voids between toner particles, which can occur as a result of the inorganic fine particles, form interfaces. As a result, a toner image breaks and detaches as a result of these voids when a strong external stress is applied.

However, particles having sizes of less than 10 nm are difficult to produce stably, and inorganic fine particles having the required dielectric constant are not obtained, meaning that the advantageous effect of the present invention cannot be achieved.

As a result of the advantageous effect mentioned above, scratch abrasion does not occur in cases where a strong external stress is applied when using media on which toners are difficult to fix, such as coated papers.

In addition, hot offset resistance is improved because inorganic fine particles present between toner particles have the function of causing toner particles to be strongly attracted to each other at the time of fixing.

In addition, in the toner prior to fixing, toner particles and inorganic fine particles are strongly attracted to each other, meaning that charge uniformity of the toner particles is improved and image half tone uniformity is improved.

In addition, by using the inorganic fine particles, charging performance of the toner is improved, image density is excellent and the occurrence of fogging is suppressed.

In cases where the inorganic fine particles are not surface treated with the alkylalkoxysilane, interactions with alkyl groups at terminals of the polyester resin cannot be achieved and the advantageous effect of the present invention cannot be achieved.

In addition, in cases where alkyl groups are not present at terminals of the polyester resin, interactions with alkyl groups at the surface of the inorganic fine particles cannot be achieved and the advantageous effect of the present invention cannot be achieved.

The content of the inorganic fine particles is preferably from 0.1 to 15.0 parts by mass, and more preferably from 0.2 to 5.0 parts by mass, relative to 100 parts by mass of the toner particle.

If the content of the inorganic fine particles falls within the range mentioned above, the surface of the toner particle is suitably covered with the inorganic fine particles, and the advantageous effect of the present invention can be achieved at interfaces following fixing. Therefore, scratch abrasion is better suppressed in cases where a strong external stress is applied when using media on which toners are difficult to fix, such as coated papers.

In addition, hot offset resistance is further improved because inorganic fine particles present between toner particles better exhibit the function of causing toner particles to be strongly attracted to each other at the time of fixing.

In addition, in the toner prior to fixing, toner particles and inorganic fine particles are strongly attracted to each other, meaning that charge uniformity of the toner particles is improved and image half tone uniformity is further improved.

In addition, the advantageous effect of the inorganic fine particles on charging performance of the toner is further improved, image density is excellent and the occurrence of fogging is better suppressed.

The crystal structure of the inorganic fine particles is preferably a perovskite structure.

By having a perovskite structure, the inorganic fine particles can be more effectively polarized, and scratch abrasion resistance, hot offset resistance and image half tone uniformity are further improved.

X-Ray diffraction measurements should be carried out in order to confirm that the crystal structure is a perovskite structure (a face-centered cubic lattice constituted from three different elements).

Examples of inorganic fine particles having a perovskite structure include calcium titanate particles and strontium titanate particles. Of these, strontium titanate particles are more preferred. Strontium titanate particles can be more effectively polarized, exhibit excellent scratch abrasion resistance, hot offset resistance, image half tone uniformity and image density, and better suppress the occurrence of fogging.

The method for producing the strontium titanate particles is not particularly limited, and the method given below can be given as an example.

A mineral acid-deflocculated product of a hydrolyzate of a titanium compound can be used as a titanium oxide source. It is preferable to use a deflocculated material in which the $SO_3$ content, as determined by means of a sulfuric acid method, is not more than 1.0 mass %, and preferably not more than 0.5 mass %, and in which the pH of meta-titanic acid is adjusted to from 0.8 to 1.5 by means of hydrochloric acid.

A nitrate or chloride of a metal, or the like, can be used as a source of a metal oxide. For example, strontium nitrate and strontium chloride can be used.

Caustic alkalis can be used as an aqueous alkaline solution, but of these, an aqueous solution of sodium hydroxide is preferred.

In the production of the strontium titanate particles, factors that influence the particle diameter include the mixing proportions of the titanium oxide source and strontium oxide source in the reaction, the concentration of the titanium oxide source in the initial stage of the reaction, and the temperature and addition speed when the aqueous alkaline solution is added.

These factors should be adjusted as appropriate in order to achieve the target particle diameter and particle size distribution. Moreover, it is preferable to prevent contamination by carbon dioxide gas by, for example, reacting in a nitrogen gas atmosphere in order to prevent generation of carbonates during the reaction process.

In addition, in the production of the strontium titanate particles, factors that influence the dielectric constant include conditions and procedures for lowering particle crystallinity. For example, it is preferable to carry out a procedure for applying energy for disrupting crystal growth in a state in which the concentration of the reaction liquid is increased. An example of a specific method is the use of microbubbling nitrogen in a crystal growth step. In addition, the content of particles having cubic and cuboid shapes can also be controlled by altering the microbubbling flow rate of nitrogen.

The mixing proportions of the titanium oxide source and strontium oxide source in the reaction is such that the $SrO/TiO_2$ molar ratio is preferably from 0.90 to 1.40, and more preferably from 1.05 to 1.20. Within the range mentioned above, unreacted titanium oxide is unlikely to remain. The concentration of the titanium oxide source in the initial stage of the reaction is preferably from 0.05 to 1.3 mol/L, and more preferably from 0.08 to 1.0 mol/L, in terms of $TiO_2$.

The temperature when the aqueous alkaline solution is added is preferably from 60° C. to 100° C. In addition, the speed of addition of the aqueous alkaline solution is such that a slower addition speed leads to strontium titanate particles having large particle diameters and a faster addition speed leads to strontium titanate particles having small particle diameters. The speed of addition of the aqueous alkaline solution is preferably from 0.001 to 1.2 eq/h, and more preferably from 0.002 to 1.1 eq/h, relative to the supplied raw materials, and should be adjusted, as appropriate, according to the particle diameter to be obtained.

In addition, in a number-based particle size distribution of the inorganic fine particles at the surface of the toner particle, if D10 is defined as the particle diameter at which the cumulative value from the small particle diameter side reaches 10 number % and D90 is defined as the particle diameter at which the cumulative value from the small particle diameter side reaches 90 number %, the particle size distribution index A, which is represented by the ratio of D10 relative to D90 (D90/D10), is preferably from 2.00 to 10.00.

In addition, the particle size distribution index A (D90/D10) ratio is more preferably from 2.00 to 5.00, and further preferably from 2.20 to 3.00.

If the particle size distribution index A represented by (D90/D10) falls within the range mentioned above, the inorganic fine particles can be present in a more uniform state at the toner particle surface.

The reason for this is that the inorganic fine particles at the toner particle surface have a somewhat broad particle size distribution, and can therefore adequately follow unevenness on the toner particle surface.

As a result, scratch abrasion resistance, hot offset resistance, image half tone uniformity and image density are excellent, and the occurrence of fogging is better suppressed.

Here, the number-based particle size distribution of the inorganic fine particles at the surface of the toner particle is preferably such that the inorganic fine particles have a somewhat broad particle size distribution at the surface of the toner particle, as mentioned above. Here, the number-based particle size distribution of the inorganic fine particles at the surface of the toner particle is calculated on the basis of not only primary particles, but also secondary particles including aggregates.

Factors that control the particle size distribution index A include the primary particle diameter and particle size distribution when the inorganic fine particles are produced, and the type, added amount and addition conditions of the surface treatment agent.

For example, rapidly cooling the aqueous solution after adding the aqueous alkaline solution and completing the reaction is preferred in order to achieve the desired particle size distribution. An example of the rapid cooling method is a method comprising introducing an aqueous solution, which is obtained by adding the aqueous alkaline solution and completing the reaction, into ice water.

In addition, as an addition condition, the temperature inside the tank of the mixer when the toner particles are mixed with the external additive is preferably such that the difference between the glass transition temperature Tg of the binder resin used in the toner particle and the temperature inside the tank (Tg—temperature inside tank) is from 10° C. to 20° C. In cases where a plurality of binder resins are used, it is preferable to control the difference between the temperature inside the tank relative to the binder resins (Tg—temperature inside tank) within the range mentioned above. By constituting in this way, it is possible to fix the inorganic fine particles on the surface of the toner particle in a state whereby the inorganic fine particles have a suitable particle size distribution.

Components that constitute the polyester resin will now be explained in detail. Moreover, it is possible to use one type or two or more types of the components listed below according to the type and intended use of the component in question.

Examples of the divalent acid component that constitutes the polyester resin include the following dicarboxylic acids and derivatives thereof. Benzenedicarboxylic acids, such as phthalic acid, terephthalic acid, isophthalic acid, and phthalic acid anhydride, and acid anhydrides and lower alkyl esters thereof; alkyldicarboxylic acids, such as succinic acid, adipic acid, sebacic acid and azelaic acid, and acid anhydrides and lower alkyl esters thereof; $C_{1-50}$ alkenylsuccinic acid and alkylsuccinic acid compounds, and acid anhydrides and lower alkyl esters thereof; and unsaturated dicarboxylic acids, such as fumaric acid, maleic acid, citraconic acid and itaconic acid, and acid anhydrides and lower alkyl esters thereof.

Meanwhile, examples of the dihydric alcohol component that constitutes the polyester resin include the following compounds. Ethylene glycol, polyethylene glycol, 1,2-propane diol, 1,3-propane diol, 1,3-butane diol, 1,4-butane diol, 2,3-butane diol, diethylene glycol, triethylene glycol, 1,5-pentane diol, 1,6-hexane diol, neopentyl glycol, 2-methyl-1,3-propane diol, 2-ethyl-1,3-hexane diol, 1,4-cyclohexanedimethanol (CHDM), hydrogenated bisphenol A, bisphenol compounds represented by formula (I) below and derivatives thereof, and diol compounds represented by formula (II) below.

(I)

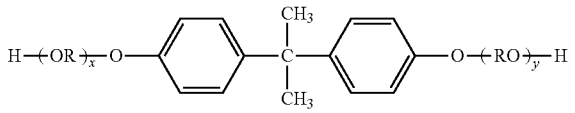

In formula (I), R is an ethylene group or propylene group, x and y are each an integer of 0 or more, and the average value of x+y is from 0 to 10.

(II)

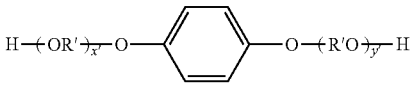

In formula (II), R' is —$CH_2CH_2$—,

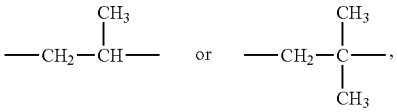

x' and y' are each an integer of 0 or more, and the average value of x'+y' is from 0 to 10.

In addition to the divalent carboxylic acid compound and dihydric alcohol compound mentioned above, trivalent or higher carboxylic acid compounds and trihydric or higher alcohol components may be contained as constituent components of the polyester resin.

Trivalent or higher carboxylic acid compounds are not particularly limited, but examples thereof include trimellitic acid, trimellitic anhydride and pyromellitic acid. In addition, examples of trihydric or higher alcohol compounds include trimethylolpropane, pentaerythritol and glycerin.

The content of an aliphatic polyhydric alcohol is preferably from 1 to 30 mol %, and more preferably from 5 to 30 mol %, of all the alcohol components that constitute the polyester resin.

By setting the content of an aliphatic polyhydric alcohol to fall within the range mentioned above, it is possible to increase the concentration of ester groups in the polyester resin and more effectively achieve interactions with the inorganic fine particles. As a result, scratch abrasion resistance, hot offset resistance, image half tone uniformity and image density are excellent, and the occurrence of fogging is better suppressed.

The method for producing the polyester resin is not particularly limited, and a publicly known method can be used. For example, the polyester resin can be produced by supplying the divalent carboxylic acid compound and dihydric alcohol compound mentioned above together with an aliphatic monocarboxylic acid or aliphatic monoalcohol, which are described later, and then polymerizing by means of an esterification reaction or transesterification reaction and a condensation reaction. In addition, the polymerization temperature when producing the polyester resin is not particularly limited, but preferably falls within the range from 180° C. to 290° C. When polymerizing the polyester, it is possible to use a polymerization catalyst such as a titanium-based catalyst, a tin-based catalyst, zinc acetate, antimony trioxide or germanium dioxide.

The polyester resin has, at a terminal, an alkyl group having an average number of carbon atoms of from 4 to 102.

For example, the polyester resin has, at a terminal, at least one type of residue selected from among an alcohol residue of an aliphatic monoalcohol having an average number of carbon atoms of from 4 to 102 and a carboxylic acid residue of an aliphatic monocarboxylic acid having an average number of carbon atoms of from 5 to 103.

An alcohol residue of an aliphatic monoalcohol having an average number of carbon atoms of from 4 to 102 means a group obtained by detaching a hydrogen atom from a hydroxyl group of an aliphatic monoalcohol having an average number of carbon atoms of from 4 to 102 (—OR; R is an alkyl group having an average number of carbon atoms of from 4 to 102). For example, a residue formed by condensation of the aliphatic monoalcohol and a carboxyl group in a polyester.

A carboxylic acid residue of an aliphatic monocarboxylic acid having an average number of carbon atoms of from 5 to 103 means a group obtained by detaching a hydrogen atom from a carboxyl group of an aliphatic monocarboxylic acid having an average number of carbon atoms of from 5 to 103 (—OC(=O)—R; R is an alkyl group having an average number of carbon atoms of from 4 to 102). For example, a residue formed by condensation of the aliphatic monocarboxylic acid and a hydroxyl group in a polyester.

In addition, the alcohol residue of an aliphatic monoalcohol having an average number of carbon atoms of from 4 to 102 and the carboxylic acid residue of an aliphatic monocarboxylic acid having an average number of carbon atoms of from 5 to 103 each contain an alkyl group having an average number of carbon atoms of from 4 to 102, as mentioned above.

The aliphatic monocarboxylic acid and aliphatic monoalcohol (also referred to simply as aliphatic compounds) are not particularly limited as long as these compounds have the specified chain length. For example, these compounds can be primary, secondary or tertiary compounds.

Specifically, examples of aliphatic monocarboxylic acids include melissic acid, lacceric acid, tetracontanoic acid and pentacontanoic acid.

In addition, examples of aliphatic monoalcohols include melissyl alcohol and tetracontanol.

In addition, if the aliphatic compound is an aliphatic monocarboxylic acid or aliphatic monoalcohol having the chain length mentioned above, the aliphatic compound may be a modified wax produced by means of a modification step for producing a wax having a hydroxyl group or carboxyl group from an aliphatic hydrocarbon-based wax. Here, modified wax means, for example, an acid-modified aliphatic hydrocarbon-based wax or an alcohol-modified aliphatic hydrocarbon-based wax.

These modified waxes do not impair the advantageous effect of the present invention if the content of a monovalent modified wax is 40 mass % or more in a mixture obtained by mixing zero-valent, monovalent and polyvalent components.

Specific examples of the acid-modified aliphatic hydrocarbon-based wax and alcohol-modified aliphatic hydrocarbon-based wax mentioned above include the compounds below.

The acid-modified aliphatic hydrocarbon-based wax is preferably a compound obtained by modifying polyethylene or polypropylene with a monovalent unsaturated carboxylic acid such as acrylic acid. Moreover, the melting point of the acid-modified wax can be controlled by adjusting the molecular weight thereof.

Among alcohol-modified aliphatic hydrocarbon-based waxes, monohydric alcohol-modified aliphatic hydrocarbon-based waxes can be obtained by, for example, polymerizing ethylene using a Ziegler catalyst and, following completion of the polymerization, oxidizing the polymer so as to produce an alkoxide of a catalyst metal and polyethylene, and then hydrolyzing the alkoxide.

In addition, a method for producing a dihydric alcohol-modified aliphatic hydrocarbon-based wax should be, for example, a method comprising subjecting an aliphatic hydrocarbon-based wax to liquid phase oxidation with a molecular oxygen-containing gas in the presence of boric acid or boric acid anhydride. The obtained hydrocarbon-based wax may be further refined using a press sweating method, refined using a solvent, hydrogenated or washed with sulfuric acid and then treated with acidic white clay. It is possible to use a mixture of boric acid and boric acid anhydride as the catalyst. The mixing ratio of boric acid and boric acid anhydride (boric acid/boric acid anhydride) is such that the molar ratio is from 1.0 to 2.0, and preferably from 1.2 to 1.7.

The added quantity of boric acid and boric acid anhydride to be used is such that the added quantity of the mixture is calculated as the boric acid quantity, and is preferably from 0.001 to 10 moles, and more preferably from 0.1 to 1 mole, relative to 1 mole of raw material aliphatic hydrocarbon.

In addition to boric acid/boric acid anhydride, metaboric acid and pyroboric acid can also be used. In addition, examples of compounds that form esters with alcohols include oxyacids of boron, oxyacids phosphorus and oxyacids of sulfur. Specific examples thereof include boric acid, nitric acid, phosphoric acid and sulfuric acid.

The molecular oxygen-containing gas blown into the reaction system can be oxygen, air or a wide variety of gases obtained by diluting oxygen or air with an inert gas. Such gases preferably have an oxygen concentration of from 1 to 30 volume %, and more preferably from 3 to 20 volume %.

The liquid phase oxidation reaction generally uses no solvent, and is carried out with a raw material aliphatic hydrocarbon being in a molten state. The reaction temperature is approximately from 120° C. to 280° C., and preferably from 150° C. to 250° C. The reaction time is preferably from 1 to 15 hours.

It is preferable for the boric acid and boric acid anhydride to be mixed in advance and then added to the reaction system. If boric acid is added in isolation, the boric acid readily undergoes a dehydration reaction. In addition, the temperature at which the mixed catalyst of boric acid and boric acid anhydride is added is preferably from 100° C. to 180° C., and more preferably from 110° C. to 160° C.

Following completion of the reaction, water is added to the reaction mixture, and the obtained boric acid ester of an aliphatic hydrocarbon-based wax is hydrolyzed/refined so as to obtain an alcohol-modified aliphatic hydrocarbon-based wax having prescribed functional groups.

Among the aliphatic compounds mentioned above, an aliphatic monoalcohol is preferred, and an alcohol-modified aliphatic hydrocarbon-based wax is more preferred from the perspective of scratch abrasion resistance.

By introducing this type of aliphatic compound at a terminal of the polyester resin by means of a chemical reaction, it is possible to achieve interactions with alkyl groups at the surface of the inorganic fine particles.

The method for condensing the aliphatic compound with the polyester resin terminal is not particularly limited. A preferred embodiment is one in which the aliphatic compound is added at the same time as the monomer that constitutes the polyester resin when the polyester resin is produced and condensation polymerization is carried out. By constituting in this way, it is possible to condense the aliphatic compound more uniformly at terminals of the polyester resin. As a result, scratch abrasion resistance, hot offset resistance, image half tone uniformity and image density are excellent, and the occurrence of fogging is better suppressed.

The content of the aliphatic compound is preferably from 0.1 to 10.0 mass %, and more preferably from 1.0 to 5.0 mass %, relative to the total amount of monomers that constitute the polyester resin that is condensed with the aliphatic compound.

If the content of the aliphatic compound falls within the range mentioned above, the aliphatic compound in the polyester resin can interact more effectively with alkyl groups at the surface of the inorganic fine particles, scratch abrasion resistance, hot offset resistance, image half tone uniformity and image density are excellent, and the occurrence of fogging is better suppressed.

In addition to the polyester resin, the binder resin may also contain another resin. A resin having a polyester structure is preferred as this other resin.

"Polyester structure" means a structure derived from a polyester, and a resin having a polyester structure encompasses, for example, a polyester resin and a hybrid resin in which a polyester structure is bonded to another polymer. In addition to the polyester resin and resin having a polyester structure, publicly known resins used in toners, such as vinyl-based resins, polyurethane resins, epoxy resins and phenol resins, can be contained as a binder resin.

In cases where two or more types of binder resin are used, the content of a component derived from a polyester structure condensed with an aliphatic compound such as that mentioned above is preferably 30 mass % or more relative to the overall binder resin.

In addition, it is more preferable to use a resin having a polyester structure condensed with an aliphatic compound such as that mentioned above in all of the two or more binder resins.

By incorporating 30 mass % or more of a component derived from a polyester structure condensed with an aliphatic compound such as that mentioned above, the aliphatic compound in the binder resin can interact more effectively with alkyl groups at the surface of the inorganic fine particles. As a result, scratch abrasion resistance, hot offset resistance, image half tone uniformity and image density are excellent, and the occurrence of fogging is better suppressed.

In cases where two or more types of binder resin are used, a resin having a softening point of from 115° C. to 170° C. should be used as a high softening point resin. Meanwhile, a resin having a softening point of not lower than 70° C. but lower than 110° C. should be used as a low softening point resin.

By using two or more types of resin having different softening points, the molecular weight distribution of the toner can be designed relatively easily, and hot offset resistance can be further improved.

The mixing ratio of these two resins having different softening points, that is, the mixing ratio of the low softening point resin and high softening point resin is preferably such that the low softening point resin:high softening point resin mass ratio is from 80:20 to 20:80.

In addition, in cases where two types of resin having different softening points are used, it is preferable to use a resin having a polyester structure condensed with an aliphatic compound such as that mentioned above in both the low softening point resin and high softening point resin. By constituting in this way, the aliphatic compound can interact more effectively with alkyl groups at the surface of the inorganic fine particles, scratch abrasion resistance, hot offset resistance, image half tone uniformity and image density are excellent, and the occurrence of fogging is better suppressed.

In addition, in cases where two types of resin having different softening points are used, the aliphatic compound that is condensed with the low softening point resin is more preferably a monohydric alcohol-modified aliphatic hydrocarbon-based wax.

Meanwhile, the aliphatic compound that is condensed with the high softening point resin is more preferably a dihydric alcohol-modified aliphatic hydrocarbon-based wax. By constituting in this way, the aliphatic compound in the binder resin can interact more effectively with alkyl groups at the surface of the inorganic fine particles, scratch abrasion resistance, hot offset resistance, image half tone uniformity and image density are excellent, and the occurrence of fogging is better suppressed.

In cases where one type of binder resin is used in isolation, the softening point thereof is preferably from 95° C. to 170° C., and more preferably from 110° C. to 160° C.

The glass transition temperature (Tg) of the binder resin is preferably at least 45° C. from the perspective of storage stability. In addition, from the perspective of low temperature fixability, the glass transition temperature (Tg) is preferably not more than 75° C., and more preferably not more than 65° C.

In addition, in cases where a hybrid resin in which a polyester structure is bonded to another polymer is used, the hybrid resin is preferably one in which a polyester structure is bonded to a vinyl-based copolymer.

In the hybrid resin, the mass ratio of the polyester structure and the vinyl-based copolymer is preferably from 50:50 to 90:10.

At least styrene can be advantageously used as a vinyl-based monomer used for producing the vinyl-based copolymer. Because a large proportion of the molecular structure of styrene is an aromatic ring, styrene is more preferred from the perspectives of easily producing a viscosity gradient inside the high softening point resin and imparting a broad fixing range. The content of styrene is preferably 70 mass % or more, and more preferably 85 mass % or more, in the vinyl-based monomer.

Examples of vinyl-based monomers other than styrene used for producing the vinyl-based copolymer include styrene-based monomers and acrylic acid-based monomers such as those listed below.

Examples of styrene-based monomers include styrene derivatives such as o-methylstyrene, m-methyl styrene, p-methyl styrene, p-phenyl styrene, p-ethylstyrene, 2,4-dimethyl styrene, p-n-butyl styrene, p-tert-butyl styrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene.

Examples of acrylic acid-based monomers include acrylic acid and acrylic acid esters, such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; α-methylene aliphatic monocarboxylic acids and esters thereof, such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and acrylic acid and methacrylic acid derivatives such as acrylonitrile, methacrylonitrile and acrylamide.

Furthermore, examples of monomers that constitute the vinyl-based copolymer include acrylic acid and methacrylic acid esters, such as 2-hydroxyethyl acrylate, 2-hydroxyethyl methacrylate and 2-hydroxypropyl (meth)acrylate; and hydroxyl group-containing monomers such as 4-(1-hydroxy-1-methylbutyl)styrene and 4-(1-hydroxy-1-methylhexyl)styrene.

It is possible to additionally use a variety of monomers capable of vinyl polymerization in the vinyl-based copolymer according to need. Examples of such monomers include ethylene-based unsaturated monoolefins, such as ethylene, propylene, butylene and isobutylene; unsaturated polyenes, such as butadiene and isoprene; halogenated vinyl compounds, such as vinyl chloride, vinylidene chloride, vinyl bromide and vinyl fluoride; vinyl esters, such as vinyl acetate, vinyl propionate and vinyl benzoate; vinyl ethers, such as vinyl methyl ether, vinyl ethyl ether and vinyl isobutyl ether; vinyl ketones, such as vinyl methyl ketone, vinyl hexyl ketone and methyl isopropenyl ketone; N-vinyl compounds, such as N-vinylpyrrole, N-vinylcarbazole, N-vinylindole and N-vinylpyrrolidone; vinylnaphthalene compounds; unsaturated dibasic acids, such as maleic acid, citraconic acid, itaconic acid, alkenylsuccinic acid compounds, fumaric acid and mesaconic acid; unsaturated dibasic acid anhydrides, such as maleic acid anhydride, citraconic acid anhydride, itaconic acid anhydride and alkenylsuccinic acid anhydride compounds; half esters of unsaturated basic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester and ethyl mesaconate half ester; unsaturated basic acid esters, such as dimethyl maleate and dimethyl fumarate; anhydrides of α,β-unsaturated acid such as crotonic acid and cinnamic acid; anhydrides of these α,β-unsaturated acids and lower fatty acids; and carboxylic acid group-containing monomers, such as alkenylmalonic acid compounds, alkenylglutaric acid compounds, alkenyladipic acid compounds, and anhydrides and monoesters of these.

In addition, the vinyl-based copolymers mentioned above may, if necessary, be polymers that are crosslinked using a crosslinkable monomer such as those exemplified below. Examples of crosslinkable monomers include aromatic divinyl compounds, diacrylate compounds linked by alkyl chains, diacrylate compounds linked by ether bond-containing alkyl chains, diacrylate compounds linked by chains including aromatic groups and ether bonds, polyester type diacrylate compounds, and polyfunctional crosslinking agents.

Examples of the aromatic divinyl compounds mentioned above include divinylbenzene and divinylnaphthalene.

Examples of the diacrylate compounds linked by alkyl chains mentioned above include ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate and compounds in which the acrylate moiety in the compounds mentioned above is replaced with a methacrylate moiety.

Examples of the diacrylate compounds linked by ether bond-containing alkyl chains mentioned above include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds in which the acrylate moiety in the compounds mentioned above is replaced with a methacrylate moiety.

Examples of the diacrylate compounds linked by chains including aromatic groups and ether bonds mentioned above include polyoxyethylene (2)-2,2-bis(4-hydroxyphenyl)propane diacrylate, polyoxyethylene (4)-2,2-bis(4-hydroxyphenyl)propane diacrylate and compounds in which the acrylate moiety in the compounds mentioned above is replaced with a methacrylate moiety. An example of a polyester type diacrylate compound is the product MANDA (available from Nippon Kayaku Co., Ltd.).

Examples of the polyfunctional crosslinking agents mentioned above include pentaerythritol triacrylate, trimethylolethane triacrylate, trimethylolpropane triacrylate, tetramethylolmethane tetraacrylate, oligoester acrylates, compounds in which the acrylate moiety in the compounds mentioned above is replaced with a methacrylate moiety; and triallyl cyanurate and triallyl trimellitate.

The vinyl-based copolymer may be produced using a polymerization initiator. The polymerization initiator is preferably used at a quantity of from 0.05 to 10 parts by mass relative to 100 parts by mass of the monomers from the perspective of efficiency.

Examples of such polymerization initiators include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butylperoxy-2-ethylhexanoate, t-butyl peroxylaurate, t-butyl peroxybenzoate, t-butyl peroxyisopropyl carbonate, di-t-butyl peroxyisophthalate, t-butyl peroxyallyl carbonate, t-amyl peroxy-2-ethylhexanoate, di-t-butyl peroxyhexahydroterephthalate and di-t-butyl peroxyazelate.

As mentioned above, the hybrid resin is a bonded product of a polyester structure and a vinyl-based copolymer.

Therefore, polymerization is preferably carried out using a compound able to react with constituent monomers of both structures (hereinafter referred to as a "bireactive compound"). Examples of this type of bireactive compound include fumaric acid, acrylic acid, methacrylic acid, citraconic acid, maleic acid and dimethyl fumarate. Of these, fumaric acid, acrylic acid and methacrylic acid can be advantageously used.

The method for obtaining the hybrid resin can be a method in which the raw material monomers of the polyester structure and the raw material monomers of the vinyl-based copolymer are reacted either simultaneously or sequentially.

For example, molecular weight control is facilitated in cases where the monomers of the vinyl-based copolymer are subjected to an addition polymerization reaction and the raw material monomers of the polyester structure are then subjected to a condensation polymerization reaction.

The usage quantity of the bireactive compound is preferably from 0.1 to 20.0 mass %, and more preferably from 0.2 to 10.0 mass %, relative to the entire amount of raw material monomers.

The toner particle may contain a release agent (a wax). From the perspectives of ease of dispersion in the toner particle and release properties, preferred examples of the wax include hydrocarbon-based waxes such as low molecular weight polyethylene, low molecular weight polypropylene, microcrystalline waxes, paraffin waxes and Fischer Tropsch waxes. In addition, it is possible to use one type of wax or a combination of two or more types of wax according to need.

The time at which to add the wax may be while carrying out melt kneading during production of the toner, but may also be during production of the binder resin, and is selected as appropriate from among existing methods.

The wax content is preferably from 1 to 20 parts by mass relative to 100 parts by mass of the binder resin. Within the range mentioned above, a sufficient release effect is achieved and dispersibility in the toner particle is also good.

The toner particle may contain a colorant. Examples of the colorant include those listed below.

Examples of black colorants include carbon black; and materials that are colored black through use of yellow colorants, magenta colorants and cyan colorants. The colorant may be a single pigment, but using a colorant obtained by combining a dye and a pigment and improving the clarity is preferred from the perspective of full color image quality.

Examples of magenta coloring pigments include the following.

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C. I. Pigment Violet 19; and C. I. Vat Red 1, 2, 10, 13, 15, 23, 29 and 35.

Examples of magenta coloring dyes include the following.

Oil-soluble dyes such as C. I. Solvent Red 1, 3, 8, 23, 24, 25, 27, 30, 49, 81, 82, 83, 84, 100, 109 and 121; C. I. Disperse Red 9; C. I. Solvent Violet 8, 13, 14, 21 and 27; and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39 and 40; and C. I. Basic Violet 1, 3, 7, 10, 14, 15, 21, 25, 26, 27 and 28.

Examples of cyan coloring pigments include the following.

C. I. Pigment Blue 2, 3, 15:2, 15:3, 15:4, 16 and 17; C. I. Vat Blue 6; C. I. Acid Blue 45; and copper phthalocyanine pigments in which from 1 to 5 phthalimidomethyl groups in the phthalocyanine skeleton are substituted.

An example of a cyan coloring dye is C. I. Solvent Blue 70.

Examples of yellow coloring pigments include the following.

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C. I. Vat Yellow 1, 3 and 20.

An example of a yellow coloring dye is C. I. Solvent Yellow 162.

The content of the colorant is preferably from 0.1 to 30 parts by mass relative to 100 parts by mass of the binder resin.

In addition, the toner particle may contain a magnetic body. Moreover, the magnetic body generally also functions as a coloring agent.

Examples of the magnetic body include iron oxides such as magnetite, hematite and ferrite; metals such as iron, cobalt and nickel; and alloys of these metals with metals such as aluminum, cobalt, copper, lead, magnesium, tin, zinc, antimony, bismuth, calcium, manganese, titanium, tungsten and vanadium; and mixtures thereof.

The number average particle diameter of the magnetic body is preferably from 0.05 to 2.0 μm, and more preferably from 0.06 to 0.50 μm.

The content of the magnetic body is preferably from 30 to 120 parts by mass, and more preferably from 40 to 110 parts by mass, relative to 100 parts by mass of the binder resin.

The toner particle may contain a charge control agent in order to stabilize charging characteristics.

The content of the charge control agent varies according to the type thereof and physical properties of other constituent materials of the toner particle, but is generally preferable for this content to be from 0.1 to 10 parts by mass, and more preferably from 0.1 to 5 parts by mass, relative to 100 parts by mass of the binder resin.

It is possible to use one type or two or more types of the charge control agent, depending on the type and intended use of the toner.

Examples of charge control agents that negatively charge a toner include the following.

Organic metal complexes (monoazo metal complexes; acetylacetone metal complexes); metal complexes and metal salts of aromatic hydroxycarboxylic acids and aromatic dicarboxylic acids; aromatic mono- and poly-carboxylic acids, and metal salts and anhydrides thereof esters; and phenol derivatives such as bisphenol.

Of these, monoazo metal complexes and metal salts able to achieve stable charging characteristics are particularly preferred.

In addition, a charge control resin can also be used, and can be used in combination with the charge control agents mentioned above. Examples of charge control resins include sulfur-containing polymers and sulfur-containing copolymers.

Examples of charge control agents that positively charge a toner include the following.

Products modified by means of nigrosine and fatty acid metal salts; quaternary ammonium salts such as tributylbenzyl ammonium-1-hydroxy-4-naphthosulfonic acid salts, tetrabutyl ammonium tetrafluoroborate, and analogs thereof; onium salts such as phosphonium salts, and lake pigments thereof; triphenylmethane dyes and Lake pigments thereof (examples of laking agents include phosphotungstic acid, phosphomolybdic acid, phosphotungstic-molybdic acid, tannic acid, lauric acid, gallic acid, ferricyanic acid and ferrocyanic compounds); and metal salts of higher fatty acids. It is possible to use one of these charge control agents or a combination of two or more types thereof. Of these, charge control agents such as nigrosine-based compounds and quaternary ammonium salts are preferred.

Inorganic fine particles other than the inorganic fine particles mentioned above may be used as the inorganic fine particles. Examples thereof include inorganic fine particles able to increase fluidity by being externally added to the toner. For example, fluororesin fine particles such as vinylidene fluoride fine particles and polytetrafluoroethylene fine particles; silica fine particles such as silica fine particles produced using a wet method and silica fine particles produced using a dry method; treated silica fine particles obtained by surface treating these silica fine particles with a treatment agent such as a silane coupling agent, a titanium coupling agent or a silicone oil; titanium oxide fine particles; alumina fine particles; treated titanium oxide fine particles; and treated alumina fine particles.

In cases where improved fluidity is an objective, the specific surface area, as measured using the nitrogen adsorption BET method, is preferably at least 30 $m^2/g$, and more preferably from 50 to 300 $m^2/g$.

The content of these is preferably from 0.01 to 8.0 parts by mass, and more preferably from 0.1 to 4.0 parts by mass, relative to 100 parts by mass of the toner particle.

The toner can also be used as a single-component developer (a magnetic toner), but may be mixed with a magnetic carrier and used as a two-component developer. Publicly known magnetic carriers such as those listed below can be used.

Iron oxide; particles of a metal such as iron, lithium, calcium, magnesium, nickel, copper, zinc, cobalt, manganese, chromium or a rare earth element, or particles of alloys or oxides of these metals; a magnetic material such as ferrite; or a magnetic material-dispersed resin carrier (a so-called resin carrier) that contains a magnetic material and a binder resin that holds the magnetic material in a dispersed state.

In cases where the toner is used as a two component developer that is mixed with a magnetic carrier, the blending proportion of the magnetic carrier in the two component developer is such that the concentration of the toner in the two component developer is preferably from 2 to 15 mass %, and more preferably from 4 to 13 mass %.

The method for producing the toner particle is not particularly limited, and a publicly known method such as a pulverization method, a suspension polymerization method or an emulsion aggregation method can be used. An example of a pulverization method will now be explained, but the method for producing the toner particle is not limited to this.

In a raw material mixing step, prescribed amounts of a binder resin and, if necessary, other components such as a colorant, a wax and a charge control agent are weighed out as materials that constitute the toner particle, blended and thoroughly mixed using a mixer.

Next, the mixed materials are melt kneaded so as to disperse the other components in the binder resin. In the raw material mixing step, the melt kneading should be carried out using a hot kneader.

A toner particle is obtained by cooling and solidifying the obtained melt kneaded product, and then pulverizing and classifying.

A toner is then obtained by thoroughly mixing the inorganic fine particles with the toner particle using a mixer.

Examples of the mixer include those listed below. A Henschel mixer (available from Mitsui Mining Co., Ltd.); a super mixer (available from Kawata Co., Ltd.); a Ribocone (available from Okawara Mfg. Co. Ltd.); a Nauta Mixer, Turbulizer or Cyclomix (available from Hosokawa Micron Corp.); a spiral pin mixer (available from Pacific Machinery & Engineering Co., Ltd.); and a Loedige Mixer (available from Matsubo Corporation).

Examples of the hot kneader include those listed below. A KRC kneader (available from Kurimoto, Ltd.); a Buss co-kneader (available from Buss AG); a TEM type extruder (available from Toshiba Machine Co., Ltd.); a TEX twin screw kneader (available from Japan Steel Works, Ltd.); a PCM kneader (available from Ikegai Corporation); a three-roll mill, mixing roll mill or kneader (available from Inoue Mfg. Inc.); a Kneadex (available from Mitsui Mining Co., Ltd.); an MS type pressurizing kneader or Kneaderuder (available from Moriyama Seisakusho); and a Banbury mixer (available from Kobe Steel Ltd.).

Examples of the pulverizer include those listed below. A counter jet mill, micron jet or Innomizer (available from Hosokawa Micron Corp.); an IDS type mill or PJM jet pulverizer (available from Nippon Pneumatic Mfg. Co., Ltd.); a cross jet mill (available from Kurimoto, Ltd.); an Ulmax (available from Nisso Engineering Co., Ltd.); an SK Jet-O-Mill (available from Seishin Enterprise Co., Ltd.); a Kryptron (available from Kawasaki Heavy Industries, Ltd.); a Turbo Mill (available from Turbo Kogyo); and a Super Rotor (available from Nisshin Engineering).

Examples of the classifier include those listed below. A Classiel, Micron Classifier or Spedic Classifier (available from Seishin Enterprise Co., Ltd.); a Turbo Classifier (available from Nisshin Engineering); a Micron separator, Turboplex (ATP), TSP Separator or TTSP Separator (available from Hosokawa Micron Corp.); an Elbow Jet (available from Nittetsu Mining Co., Ltd.); a dispersion separator (available from Nippon Pneumatic Mfg. Co., Ltd.); and a YM Micro Cut (available from Yasukawa Corporation).

Examples of classifying apparatuses able to be used for classifying and separating coarse particles include those listed below. An Ultrasonic (available from Koei Sangyo Co., Ltd.); a Rezona Sieve or Gyro Sifter (available from Tokuju Co., Ltd.); a Vibrasonic System (available from Dalton); a Soniclean (available from Sinto Kogyo); a Turbo Screener (available from Turbo Kogyo); a Micron Sifter (available from Makino Mfg. Co., Ltd.); and a circular vibrating sieve.

Explanations will now be given of methods for measuring a variety of physical properties of the toner and other materials.

Physical properties of the inorganic fine particles may be measured using the toner as a sample. In addition, in cases where physical properties of the inorganic fine particles and toner particles are measured using a toner to which the inorganic fine particles have been externally added, it is possible to carry out measurements after separating the inorganic fine particles and other external additives from the toner.

For example, a toner is dispersed in water by means of ultrasonic waves so as to remove the inorganic fine particles and other external additives, and then allowed to stand for 24 hours. The sedimented toner particles and the inorganic fine particles and other external additives dispersed in the supernatant liquid are separated, recovered and thoroughly dried so as to isolate the toner particles. In addition, by subjecting the supernatant liquid to centrifugal separation, it is possible to isolate the inorganic fine particles.

Methods for Calculating Number Average Particle Diameter of Primary Particles of Inorganic Fine Particles and Particle Size Distribution Index A of Inorganic Fine Particles at Toner Particle Surfaces Physical properties of the inorganic fine particles were calculated by using image analysis software (Image-Pro Plus ver. 5.0, available from Nippon Roper Kabushiki Kaisha) to analyze images of surfaces of the inorganic fine particles or toner particles, the images being taken using a Hitachi ultrahigh resolution field emission scanning electron microscope (SEM; S-4800, available from Hitachi High-Technologies Corporation). More specifically, the methods are carried out in the following way.

(1) Sample Preparation

An electrically conductive paste is thinly coated on a specimen mount (an aluminum sample stand measuring 15 mm×6 mm), and particles to be measured are sprayed onto this specimen mount. Excess particles are blown from the specimen mount using an air blower, and the paste is then thoroughly dried. The specimen mount is placed on a specimen holder, and the height of the specimen mount is adjusted to be 36 mm using a specimen height gauge.

(2) Setting S-4800 Observation Conditions

Liquid nitrogen is poured into an anti-contamination trap fitted to the housing of the S-4800 until the liquid nitrogen overflows, and the anti-contamination trap is then allowed to stand for 30 minutes. "PC-SEM" of the S-4800 is started, and flushing is carried out (cleaning of an FE chip that is an electron source). The accelerating voltage display section on the control panel of the screen is clicked, the [Flushing] button is pressed, and the flushing dialogue is opened. Flushing is carried out after confirming that the flushing strength is 2. It is confirmed that the emission current in the flushing is from 20 to 40 μA. The specimen holder is inserted into a specimen chamber in the S-4800 housing. [Start point] on the control panel is pushed, and the specimen holder is moved to the observation position.

The HV settings dialog is opened by clicking the accelerating voltage display section, and the accelerating voltage is set to [1.1 kV] and the emission current is set to [20 μA]. Signal selection is set to [SE] in the [Basics] tab on the operation panel, [Upper (U)] and [+BSE] are selected for the SE detector, [L.A.100] is selected in the selection box on the right of [+BSE], and the apparatus is set to a mode in which observation is carried out with a backscattered electron image. Similarly, the probe current is set to [Normal], the focusing mode is set to [UHR] and WD is set to [4.5 mm] in the electron optical system conditions block in the [Basics] tab on the operation panel. The [ON] button on the accelerating voltage display section of the control panel is pushed, and an accelerating voltage is applied.

(3) Focus Adjustment

Aperture alignment is adjusted after the [COARSE] focusing knob on the operation panel is rotated and focusing is more or less in focus. [Align] on the control panel is clicked, the alignment dialog is displayed, and [Beam] is selected. The STIGMA/ALIGNMENT knob (X, Y) on the operation panel is rotated, and the displayed beam is moved to the center of concentric circles. Next, [Aperture] is selected, the STIGMA/ALIGNMENT knob (X, Y) is rotated one step each so that image movement is stopped or minimum movement is attained. The Aperture dialog is closed, and focus is obtained through autofocus. Next, the magnification is set to 80,000 times, focus adjustment is carried out using the focusing knob and the STIGMA/ALIGNMENT knob in the same way as mentioned above, and focus is again obtained through autofocus. Focus is obtained by repeating this procedure. Here, because measurement precision of coverage ratio tends to decrease as the angle of inclination of the observation surface increases, analysis is carried out by selecting a surface having inclination as low as possible by selecting in such a way that the entire observation surface is in focus at the same time when focus adjustment is carried out.

(4) Image Storage

Brightness adjustment is carried out in ABC mode, and a photograph is taken at a size of 640×480 pixels and stored.

This image file is analyzed in the manner described below. A plurality of photographs are taken, and a number of images are obtained so that at least 500 particles can be analyzed.

(5) Image Analysis

The particle diameters of primary particles of 500 inorganic fine particles are measured, and the arithmetic mean value thereof is taken to be the number average particle diameter. The long axis is measured as the particle diameter. In the present invention, the number average particle diameter is calculated by binarizing images using Image-Pro Plus ver. 5.0 image analysis software.

Moreover, the number average particle diameter of primary particles of inorganic fine particles at toner particle surfaces can also be measured using the same method.

However, the particle size distribution index A, which is represented by (D90/D10), in the number-based particle size distribution of the inorganic fine particles at the surface of the toner particle, is calculated on the basis of secondary particles which include aggregates instead of primary particles.

In addition, when measuring the particle diameters of inorganic fine particles at toner particle surfaces, measurements are carried out after specifying particles to be measured at toner particle surfaces by means of elemental analysis using an energy dispersive X-Ray analyzer (EDAX) in advance.

For example, strontium titanate particles and other external additives are differentiated from each other by analyzing toner particle surfaces in the field of view using Energy Dispersive X-Ray Spectroscopy (EDX), and images obtained by extracting only strontium titanate particles at the surface of toner particles are binarized and then analyzed.

The cumulative frequency of circle-equivalent diameters are determined from the obtained images, a particle diameter at which the cumulative value from the small particle diameter side reaches 10 number % is denoted by D10, a particle diameter at which the cumulative value from the small particle diameter side reaches 50 number % from the small particle diameter side is denoted by D50, and a particle diameter at which the cumulative value from the small particle diameter side reaches 90 number % from the small particle diameter side is denoted by D90.

Ten toner particles are analyzed by the same procedure, and average values thereof are calculated.

From these values thus obtained, the D50 value and the particle size distribution index A, which is represented by value of D90 relative to D10 (D90/D10), are determined.

Method for Measuring Weight Average Particle Diameter (D4) of Toner (Particles)

The weight-average particle diameter (D4) of toner (particles) is determined by measuring the toner particles using a precision particle size distribution measuring device which employs a pore electrical resistance method and is equipped with a 100 μm aperture tube "Coulter Counter Multisizer 3" (registered trademark, available from Beckman Coulter) and accompanying dedicated software that is used to set measurement conditions and analyze measured data "Beckman Coulter Multisizer 3 Version 3.51" (produced by Beckman Coulter) at effective measurement channels of 25,000, and then analyzing the measurement data.

A solution obtained by dissolving special grade sodium chloride in deionized water at a concentration of approximately 1 mass %, such as "ISOTON II" (produced by Beckman Coulter), can be used as an aqueous electrolyte solution used in the measurements.

Moreover, the dedicated software was set up as follows before carrying out measurements and analysis.

On the "Standard Operating Method (SOM) alteration screen" in the dedicated software, the total count number in control mode is set to 50,000 particles, the number of measurements is set to 1, and the Kd value is set to a value obtained by using "standard particle 10.0 μm" (Beckman Coulter). By pressing the threshold value/noise level measurement button, threshold values and noise levels are automatically set. In addition, the current is set to 1600 μA, the gain is set to 2, the aqueous electrolyte solution is set to ISOTON II, and the flush aperture tube after measurement option is checked.

On the "Screen for converting from pulse to particle diameter" in the dedicated software, the bin spacing is set to logarithmic particle size, the particle size bin is set to 256 particle size bin, and the particle size range is set to from 2 to 60 μm.

The specific measurement method is as described in steps (1) to (7) below.

(1) About 200 mL of the aqueous electrolyte solution is placed in a 250 mL glass round bottomed beaker dedicated to Multisizer 3, the beaker is set on a sample stand, and a stirring rod is rotated anticlockwise at a rate of 24 rotations/second. By carrying out the "Aperture flush" function of the dedicated software, dirt and bubbles in the aperture tube are removed.

(2) 30 mL of the aqueous electrolyte solution is placed in a 100 mL glass flat bottomed beaker, and approximately 0.3 mL of a diluted liquid, which is obtained by diluting "Contaminon N" (a 10 mass % aqueous solution of a neutral detergent for cleaning precision measurement equipment, which has a pH of 7 and comprises a non-ionic surfactant, an anionic surfactant and an organic builder, available from Wako Pure Chemical Industries, Ltd.) 3-fold in mass with deionized water, is added to the beaker as a dispersant.

(3) A prescribed amount of deionized water is placed in a water bath of an "Ultrasonic Dispersion System Tetora 150" (available from Nikkaki Bios Co., Ltd.) having an electrical output of 120 W, in which two oscillators having an oscillation frequency of 50 kHz are housed so that their phases are staggered by 180°, and approximately 2 mL of the Contaminon N is added to the water bath.

(4) The beaker mentioned in section (2) above is placed in a beaker-fixing hole of the ultrasonic disperser, and the ultrasonic disperser is activated. The height of the beaker is adjusted so that the resonant state of the liquid surface of the aqueous electrolyte solution in the beaker is at a maximum.

(5) While the aqueous electrolyte solution in the beaker mentioned in section (4) above is ultrasonicated, approximately 10 mg of toner (particles) are added gradually to the aqueous electrolyte solution and dispersed therein. The ultrasonic dispersion treatment is continued for a further 60 seconds. Moreover, when carrying out the ultrasonic dispersion, the temperature of the water bath is adjusted as appropriate to a temperature of from 10° C. to 40° C.

(6) The aqueous electrolyte solution mentioned in section (5) above, in which the toner (particles) is dispersed, is added dropwise using a pipette to the round bottomed beaker mentioned in section (1) above, which is disposed on the sample stand, and the measurement concentration is adjusted to approximately 5%. Measurements are continued until the number of particles measured reaches 50,000.

(7) The weight-average particle diameter (D4) is calculated by analyzing measurement data using the accompanying dedicated software. Moreover, when setting the graph/vol % with the dedicated software, the "average diameter"

on the analysis/volume-based statistical values (arithmetic mean) screen is weight-average particle diameter (D4).

Method for Measuring Softening Point (Tm) of Resin

The softening point of the resin is measured using a constant load extrusion type capillary rheometer "Flow Tester CFT-500D Flow Characteristics Analyzer" (available from Shimadzu Corporation), with the measurements being carried out in accordance with the manual provided with the apparatus.

In this apparatus, the temperature of a measurement sample filled in a cylinder is increased while a constant load is applied from above by means of a piston, thereby melting the sample, the molten measurement sample is extruded through a die at the bottom of the cylinder, and a flow curve showing a relationship between the amount of piston fall and the temperature during this process is obtained.

In addition, the softening temperature was taken to be the "melting temperature by the half method" described in the manual provided with the "Flow Tester CFT-500D Flow Characteristics Analyzer".

Moreover, the melting temperature by the half method is calculated as follows.

First, half of the difference between the amount of piston fall at the completion of outflow (Smax) and the amount of piston fall at the start of outflow (Smin) is determined (this is designated as X; X=(Smax−Smin)/2). Next, the temperature in the flow curve when the amount of piston fall reaches the sum of X and Smin is taken to be the melting temperature by the half method.

The measurement sample used is prepared by subjecting approximately 1.0 g of a resin to compression molding for approximately 60 seconds at approximately 10 MPa in a 25° C. environment using a tablet compression molder (NT-100H available from NPa System Co., Ltd.) to provide a cylindrical shape with a diameter of approximately 8 mm.

The measurement conditions for the Flow Tester CFT-500D are as follows.

Test mode: Ascending temperature method
Start temperature: 50° C.
End point temperature: 200° C.
Measurement interval: 1.0° C.
Temperature increase rate: 4.0° C./min
Piston cross section area: 1.000 $cm^2$
Test load (piston load): 10.0 kgf (0.9807 MPa)
Preheating time: 300 sec
Diameter of die orifice: 1.0 mm
Die length: 1.0 mm Method for Measuring Average Number of Carbon Atoms in Aliphatic Compound The distribution of the number of carbon atoms in the aliphatic compound is measured by means of gas chromatography (GC) in the manner described below.

10 mg of a sample is precisely measured out and placed in a sample bottle. Exactly 10 g of hexane is added to the sample bottle, which is then sealed, and the contents of the sample bottle are mixed while being heated at 150° C. on a hot plate.

The sample is quickly injected into the injection port of a gas chromatography apparatus so that the aliphatic compound does not precipitate, and analysis is carried out using the measurement apparatus and measurement conditions described below.

A chart is obtained in which the horizontal axis is the number of carbon atoms and the vertical axis is the signal intensity. Next, the ratio of the area of a peak attributable to a component having a certain number of carbon atoms relative to the total area of all the detected peaks in the obtained chart is calculated, and this is taken to be the content (areal %) of the hydrocarbon compound in question. In addition, a chart of the distribution of the number of carbon atoms is prepared, in which the horizontal axis is the number of carbon atoms and the vertical axis is the content (areal %) of the hydrocarbon compound in question.

In addition, the number of carbon atoms at the peak top of the chart of the distribution of the number of carbon atoms is taken to be the average number of carbon atoms.

The measurement apparatus and measurement conditions are as follows.

GC: 6890GC available from HP
Column: ULTRA ALLOY-1, P/N: UA1-30M-0.5F (available from Frontier Laboratories Ltd.)
Carrier gas: He
Oven:
(1) Temperature held at 100° C. for 5 minutes
(2) Temperature increased to 360° C. at a rate of 30° C./min
(3) Temperature held at 360° C. for 60 minutes
Injection port: Temperature 300° C.
Initial pressure: 10.523 psi
Split ratio: 50:1
Column flow rate: 1 mL/min Method for Measuring BET Specific Surface Area of Inorganic Fine Particles The BET specific surface area of the inorganic fine particles is measured in accordance with JIS Z8830 (2001). The specific measurement method is as follows.

A "TriStar 3000" automatic specific surface area/pore distribution measurement apparatus (available from Shimadzu Corporation), which uses a fixed volume-based gas adsorption method as a measurement method, is used as the measurement apparatus.

Setting of measurement conditions and analysis of measured data are carried out using "TriStar 3000 Version 4.00" dedicated software provided with the apparatus.

In this apparatus, a vacuum pump, nitrogen gas piping and helium gas piping are connected. The BET specific surface area of the inorganic fine particles herein is a value calculated by means of a BET multipoint method using nitrogen gas as the adsorbed gas.

Moreover, the BET specific surface area is calculated in the manner described below.

First, nitrogen gas is adsorbed by the inorganic fine particles, and the equilibrium pressure P (Pa) in the sample cell and the adsorbed amount of nitrogen on the external additive Va (mol/g) are measured at this point. In addition, an adsorption isothermal line is obtained, with relative pressure Pr, which is a value obtained by dividing the equilibrium pressure P (Pa) in the sample cell by the saturated vapor pressure of nitrogen Po (Pa), being the horizontal axis and the adsorbed amount of nitrogen Va (mol/g) being the vertical axis. Next, the unimolecular layer adsorption amount Vm (mol/g), which is the adsorbed amount required to form a unimolecular layer on the surface of the external additive, is determined using the BET equation below.

$$Pr/Va(1-Pr)=1/(Vm\times C)+(C-1)\times Pr/(Vm\times C)$$

Here, C denotes the BET parameter, and is a variable that varies according to the type of measurement sample, the type of gas being adsorbed and the adsorption temperature.

If the X axis is Pr and the Y axis is Pr/Va(1−Pr), it can be understood that the BET equation is a straight line in which the slope is (C−1)/(Vm×C) and the intercept is 1/(Vm×C). This straight line is known as a BET plot.

$$\text{Slope of straight line}=(C-1)/(Vm\times C)$$

$$\text{Intercept of straight line}=1/(Vm\times C)$$

By plotting measured values for Pr and measured values for Pr/Va(1−Pr) on a graph and drawing a straight line using the least squares method, it is possible to calculate the slope of the straight line and the intercept value. By inputting these values into the numerical formula above and solving the obtained simultaneous equations, it is possible to calculate Vm and C.

Furthermore, the BET specific surface area S ($m^2/g$) of the inorganic fine particles is calculated from the Vm value obtained above and the molecular cross sectional area of a nitrogen molecule (0.162 $nm^2$) using the formula below.

$$S=Vm\times N\times 0.162\times 10^{-18}$$

Here, N denotes Avogadro's number ($mol^{-1}$).

Measurements using this apparatus are carried out in accordance with the "TriStar 3000 user manual V4.0" provided with the apparatus, and specifically carried out using the procedure below.

The tare mass of a thoroughly washed and dried dedicated glass sample cell (stem diameter ⅜ inch, volume approximately 5 mL) is precisely measured. Next, approximately 0.1 g of an external additive is placed in the sample cell using a funnel.

The sample cell containing the inorganic fine particles is placed in a "Vacuprep 061" pretreatment device (available from Shimadzu Corporation) connected to a vacuum pump and nitrogen gas piping, and vacuum degassing is continued for approximately 10 hours at a temperature of 23° C. Moreover, when degassing under vacuum is carried out, air is gradually removed while adjusting a valve so that the inorganic fine particles are not drawn into the vacuum pump. The pressure inside the sample cell gradually decreases as air is removed, and finally reaches a pressure of approximately 0.4 Pa (approximately 3 millitorr). After completion of the vacuum degassing, nitrogen gas is slowly injected into the sample cell to increase the pressure in the sample cell up to atmospheric pressure again, and the sample cell is removed from the pretreatment device. In addition, the mass of the sample cell is precisely weighed, and the exact mass of the external additive is calculated from the difference between the mass of the sample cell and the tare mass mentioned above. Here, the sample cell is sealed with a rubber plug while being weighed so that the external additive in the sample cell is not contaminated by moisture in the air, or the like.

Next, a dedicated "isothermal jacket" is attached to the stem part of the sample cell containing the inorganic fine particles. Dedicated filler rods are then inserted into the sample cell, and the sample cell is placed in an analysis port of the apparatus. Here, the isothermal jacket is a cylindrical member which has an inner surface constituted from a porous material and an outer surface constituted from an impervious material and which can draw liquid nitrogen up to a certain level by means of capillary action.

Next, free space of the sample cell including connected equipment is measured. Free space is calculated by measuring the volume of the sample cell using helium gas at a temperature of 23° C., then the volume of the sample cell after the sample cell is cooled by means of liquid nitrogen is measured using helium gas, and then the difference between these volumes is calculated. In addition, the saturated vapor pressure of nitrogen Po (Pa) is automatically measured separately using a Po tube housed in the apparatus.

Next, the sample cell is subjected to vacuum degassing, and then cooled by means of liquid nitrogen while continuing the vacuum degassing. Next, nitrogen gas is introduced gradually into the sample cell and nitrogen molecules are adsorbed on the inorganic fine particles. Here, because the adsorption isothermal line mentioned above is obtained by measuring the equilibrium pressure P (Pa) continuously, this adsorption isothermal line is converted into a BET plot. Moreover, the relative pressure Pr points at which data is collected are a total of 6 points, namely 0.05, 0.10, 0.15, 0.20, 0.25 and 0.30. A straight line is drawn from the obtained measurement data using the least squares method, and the value of Vm is calculated from the slope and intercept of this straight line. Furthermore, the BET specific surface area of the inorganic fine particles is calculated from this Vm value in the manner described above.

Method for Measuring Dielectric Constant of Inorganic Fine Particles

Using a 284A precision LCR meter (available from Hewlett-Packard), calibration is carried out at frequencies of 1 kHz and 1 MHz, and the complex dielectric constant is then measured at a frequency of 1 MHz.

A load of 39,200 kPa (400 $kg/cm^2$) is applied to a sample for a period of 5 minutes, and the sample is molded into the shape of a disk having a diameter of 25 mm and a thickness of 1 mm or less (approximately from 0.5 to 0.9 mm).

The obtained measurement sample is placed on an ARES (available from Rheometric Scientific FE) fitted with a dielectric constant measurement jig (electrode) having a diameter of 25 mm, and the dielectric constant is measured at a frequency of 1 MHz in an atmosphere having a temperature of 25° C. and in a state whereby a load of 0.49 N (50 g) is applied.

EXAMPLES

The present invention will now be explained by means of production examples and examples, but is in no way limited to these examples. Moreover, numbers of parts in the examples and comparative examples are all based on masses, unless explicitly stated otherwise.

Production Example of Inorganic Fine Particles 1

Meta-titanic acid produced using the sulfuric acid method was subjected to iron removal and bleaching, after which a 3 mol/L aqueous solution of sodium hydroxide was added, the pH was adjusted to 9.0, and desulfurization treatment was carried out.

The meta-titanic acid was then neutralized to a pH of 5.6 by means of 5 mol/L hydrochloric acid, filtered and then washed with water. Water was added to the washed cake so as to obtain a slurry containing 1.90 mol/L of $TiO_2$, after which the pH was adjusted to 1.4 by means of hydrochloric acid, and deflocculation treatment was carried out.

1.90 mol (in terms of $TiO_2$) of desulfurized and deflocculated meta-titanic acid was obtained and placed in a 3 L reaction vessel. 2.185 mol of an aqueous solution of strontium chloride was added to the deflocculated meta-titanic acid slurry so that the $SrO/TiO_2$ molar ratio was 1.15, and the $TiO_2$ concentration was then adjusted to 1.039 mol/L.

Next, the temperature was increased to 90° C. while stirring and mixing, 440 mL of a 10 mol/L aqueous solution of sodium hydroxide was added over a period of 40 minutes while microbubbling nitrogen gas at a rate of 600 mL/min, and stirring was then carried out at 95° C. for a further 45 minutes while microbubbling nitrogen gas at a rate of 400 mL/min.

The reaction was then terminated through rapid cooling by introducing the slurry into ice water.

This reaction slurry was heated to 70° C., 12 mol/L hydrochloric acid was added until the pH reached 5.0, stirring was continued for 1 hour, and the obtained precipitate was decanted.

The slurry containing the obtained precipitate was adjusted to a temperature of 40° C., hydrochloric acid was added so as to adjust the pH to 2.5, and n-octyltriethoxysilane was then added in an amount of 8.0 mass % relative to the solid content and stirred for 10 hours. A 5 mol/L aqueous solution of sodium hydroxide was added so as to adjust the pH to 6.5, stirring was continued for 1 hour, the slurry was then filtered and washed, and the obtained cake was dried for 8 hours in air at a temperature of 120° C. so as to obtain inorganic fine particles 1. The obtained inorganic fine particles 1 had a dielectric constant of 72.0 pF/m. Physical properties are shown in Table 1-2.

Production Example of Inorganic Fine Particles 2

Inorganic fine particles 2 were obtained in the same way as in the production example of inorganic fine particles 1, except that treatment agent 1 was replaced by the treatment agent shown in Table 1-2. Physical properties are shown in Table 1-2.

Production Example of Inorganic Fine Particles 3

Inorganic fine particles 3 were obtained in the same way as the production example of inorganic fine particles 1, except that the type of treatment agent 1 and the treatment amount were changed to those shown in Table 1-2, and 3,3,3-trifluoropropyltrimethoxysilane (treatment agent 2) was added at a quantity of 5.0 mass % relative to the solid at the same as treatment agent 1 was added. Physical properties are shown in Table 1-2.

Production Example of Inorganic Fine Particles 4

Inorganic fine particles 4 were obtained in the same way as in the production example of inorganic fine particles 1, except that the dropwise addition time of the 10 mol/L aqueous solution of sodium hydroxide, the type of treatment agent 1 and the treatment amount were changed to those shown in Table 1-1 and Table 1-2. Physical properties are shown in Table 1-2.

Production Example of Inorganic Fine Particles 5 and 6

Inorganic fine particles 5 and 6 were obtained in the same way as in the production example of inorganic fine particles 1, except that the $TiO_2$ concentration, the dropwise addition time, stirring time, the type of treatment agent 1 and the treatment amount were changed to those shown in Table 1-1 and Table 1-2. Physical properties are shown in Table 1-2.

Production Example of Inorganic Fine Particles 7

Meta-titanic acid produced using the sulfuric acid method was subjected to iron removal and bleaching, after which a 3 mol/L aqueous solution of sodium hydroxide was added, the pH was adjusted to 9.0, and desulfurization treatment was carried out.

The meta-titanic acid was then neutralized to a pH of 5.6 by means of 5 mol/L hydrochloric acid, filtered and then washed with water. Water was added to the washed cake so as to obtain a slurry containing 1.90 mol/L of $TiO_2$, after which the pH was adjusted to 1.4 by means of hydrochloric acid, and deflocculation treatment was carried out.

1.90 mol (in terms of $TiO_2$) of desulfurized and deflocculated meta-titanic acid was obtained and placed in a 3 L reaction vessel. 2.185 mol of an aqueous solution of strontium chloride was added to the deflocculated meta-titanic acid slurry so that the $SrO/TiO_2$ molar ratio was 1.15, and the $TiO_2$ concentration was then adjusted to 0.969 mol/L.

Next, the temperature was increased to 90° C. while stirring and mixing, 440 mL of a 10 mol/L aqueous solution of sodium hydroxide was added over a period of 80 minutes, stirring was then continued at 95° C. for a further 45 minutes, and the reaction was then terminated through rapid cooling by introducing the slurry into ice water.

This reaction slurry was heated to 70° C., 12 mol/L hydrochloric acid was added until the pH reached 5.0, stirring was continued for 1 hour, and the obtained precipitate was decanted.

The slurry containing the obtained precipitate was adjusted to a temperature of 40° C., hydrochloric acid was added so as to adjust the pH to 2.5, and isobutyltrimethoxysilane (treatment agent 1) was then added in an amount of 20.0 mass % relative to the solid content and stirred for 10 hours. A 5 mol/L aqueous solution of sodium hydroxide was added so as to adjust the pH to 6.5, stirring was continued for 1 hour, the slurry was then filtered and washed, and the obtained cake was dried for 8 hours in air at a temperature of 120° C. so as to obtain inorganic fine particles 7. Physical properties are shown in Table 1-2.

Production Example of Inorganic Fine Particles 8

Inorganic fine particles 8 were obtained in the same way as in the production example of inorganic fine particles 7, except that the dropwise addition time, stirring time and treatment amount of treatment agent 1 were changed to those shown in Table 1-1 and Table 1-2. Physical properties are shown in Table 1-2.

Production Example of Inorganic Fine Particles 9

Meta-titanic acid produced using the sulfuric acid method was subjected to iron removal and bleaching, after which a 3 mol/L aqueous solution of sodium hydroxide was added, the pH was adjusted to 9.0, and desulfurization treatment was carried out.

The meta-titanic acid was then neutralized to a pH of 5.6 by means of 5 mol/L hydrochloric acid, filtered and then washed with water. Water was added to the washed cake so as to obtain a slurry containing 1.90 mol/L of $TiO_2$, after which the pH was adjusted to 1.4 by means of hydrochloric acid, and deflocculation treatment was carried out.

1.90 mol (in terms of $TiO_2$) of desulfurized and deflocculated meta-titanic acid was obtained and placed in a 3 L reaction vessel. 2.185 mol of an aqueous solution of strontium chloride was added to the deflocculated meta-titanic acid slurry so that the $SrO/TiO_2$ molar ratio was 1.15, and the $TiO_2$ concentration was then adjusted to 0.921 mol/L.

Next, the temperature was increased to 90° C. while stirring and mixing, 440 mL of a 10 mol/L aqueous solution of sodium hydroxide was added over a period of 45 minutes, and stirring was then continued at 95° C. for a further 45 minutes.

This reaction slurry was then cooled to 70° C., 12 mol/L hydrochloric acid was added until the pH reached 5.0, stirring was continued for 1 hour, and the obtained precipitate was decanted.

The slurry containing the obtained precipitate was adjusted to a temperature of 40° C., hydrochloric acid was added so as to adjust the pH to 2.5, and isobutyltrimethoxysilane (treatment agent 1) was then added in an amount of 3.0 mass % relative to the solid content and stirred for 10 hours. A 5 mol/L aqueous solution of sodium hydroxide was added so as to adjust the pH to 6.5, stirring was continued for 1 hour, the slurry was then filtered and washed, and the obtained cake was dried for 8 hours in air at a temperature of 120° C. so as to obtain inorganic fine particles 9. Physical properties are shown in Table 1-2.

Production Examples of Inorganic Fine Particles 10 to 13, 15 and 16

Inorganic fine particles 10 to 13, 15 and 16 were obtained in the same way as in the production example of inorganic fine particles 9, except that the $TiO_2$ concentration, the concentration of the aqueous solution of sodium hydroxide added dropwise, the dropwise addition time, the stirring time following the dropwise addition, the type of treatment agent 1 and the treatment amount were changed to those shown in Table 1-1 and Table 1-2. Physical properties are shown in Table 1-2.

Production Example of Inorganic Fine Particles 14

Inorganic fine particles 14 were obtained in the same way as in the production example of inorganic fine particles 13, except that the strontium chloride was replaced with calcium chloride. Physical properties are shown in Table 1-2.

TABLE 1-1

| Inorganic fine particles No. | DT (pH) | Supply: $TiO_2$ conc. (mol/L) | Supply: Metal source | Supply: Molar ratio | Reaction: Heating temperature (° C.) | Reaction: NaOH conc. (mol/L) | Reaction: Dropwise addition time (min) | Reaction: MB | Reaction: Stirring temperature (° C.) | Reaction: Stirring time (min) | Reaction: Rapid cooling (ice) | Acid treatment: pH | Acid treatment: Treatment time (hours) |
|---|---|---|---|---|---|---|---|---|---|---|---|---|---|
| 1 | 1.4 | 1.039 | $SrCl_2$ | 1.15 | 90 | 10 | 40 | Yes | 95 | 45 | Yes | 5.0 | 1 |
| 2 | 1.4 | 1.039 | $SrCl_2$ | 1.15 | 90 | 10 | 40 | Yes | 95 | 45 | Yes | 5.0 | 1 |
| 3 | 1.4 | 1.039 | $SrCl_2$ | 1.15 | 90 | 10 | 40 | Yes | 95 | 45 | Yes | 5.0 | 1 |
| 4 | 1.4 | 1.039 | $SrCl_2$ | 1.15 | 90 | 10 | 60 | Yes | 95 | 45 | Yes | 5.0 | 1 |
| 5 | 1.4 | 1.039 | $SrCl_2$ | 1.15 | 90 | 10 | 45 | Yes | 95 | 30 | Yes | 5.0 | 1 |
| 6 | 1.4 | 1.112 | $SrCl_2$ | 1.15 | 90 | 10 | 45 | Yes | 95 | 45 | Yes | 5.0 | 1 |
| 7 | 1.4 | 0.969 | $SrCl_2$ | 1.15 | 90 | 10 | 80 | No | 95 | 45 | Yes | 5.0 | 1 |
| 8 | 1.4 | 0.969 | $SrCl_2$ | 1.15 | 90 | 10 | 35 | No | 95 | 30 | Yes | 5.0 | 1 |
| 9 | 1.4 | 0.921 | $SrCl_2$ | 1.15 | 90 | 10 | 45 | No | 95 | 45 | No | 5.0 | 1 |
| 10 | 1.4 | 1.443 | $SrCl_2$ | 1.15 | 90 | 12 | 50 | No | 95 | 30 | No | 5.0 | 1 |
| 11 | 1.4 | 1.443 | $SrCl_2$ | 1.15 | 90 | 12 | 50 | No | 95 | 30 | No | 5.0 | 1 |
| 12 | 1.4 | 1.443 | $SrCl_2$ | 1.15 | 90 | 12 | 50 | No | 95 | 30 | No | 5.0 | 1 |
| 13 | 1.4 | 1.443 | $SrCl_2$ | 1.15 | 90 | 12 | 50 | No | 95 | 30 | No | 5.0 | 1 |
| 14 | 1.4 | 1.443 | $CaCl_2$ | 1.15 | 90 | 12 | 50 | No | 95 | 30 | No | 5.0 | 1 |
| 15 | 1.4 | 1.443 | $SrCl_2$ | 1.15 | 90 | 12 | 50 | No | 95 | 30 | No | 5.0 | 1 |
| 16 | 1.4 | 1.443 | $SrCl_2$ | 1.15 | 90 | 12 | 60 | No | 95 | 30 | No | 5.0 | 1 |

In the table,
DT indicates "deagglomeration treatment", and
MB indicates "microbubbling".

TABLE 1-2

| Inorganic fine particles No. | Surface treatment: Treatment agent 1 | Surface treatment: Treatment amount (mass %) | Surface treatment: Treatment agent 2 | Surface treatment: Treatment amount (mass %) | Physical properties of inorganic fine particles: Number average particle diameter of primary particles (nm) | Physical properties of inorganic fine particles: Dielectric constant (25° C., 1 MHz) (pF/m) |
|---|---|---|---|---|---|---|
| 1 | 1-1 | 8.0 | — | — | 40 | 72.0 |
| 2 | 1-2 | 8.0 | — | — | 40 | 72.0 |
| 3 | 1-2 | 5.0 | 2-1 | 5.0 | 40 | 72.0 |
| 4 | 1-2 | 5.0 | — | — | 70 | 80.0 |
| 5 | 1-2 | 12.0 | — | — | 25 | 65.0 |
| 6 | 1-2 | 13.0 | — | — | 25 | 65.0 |
| 7 | 1-2 | 20.0 | — | — | 75 | 81.0 |
| 8 | 1-2 | 3.0 | — | — | 11 | 56.0 |
| 9 | 1-2 | 3.0 | — | — | 90 | 100.0 |
| 10 | 1-2 | 3.0 | — | — | 90 | 100.0 |
| 11 | 1-3 | 3.0 | — | — | 90 | 100.0 |
| 12 | 1-4 | 3.0 | — | — | 90 | 100.0 |
| 13 | 1-5 | 2.0 | — | — | 90 | 100.0 |
| 14 | 1-5 | 2.0 | — | — | 90 | 55.0 |

TABLE 1-2-continued

| Inorganic fine particles No. | Surface treatment: Treatment agent 1 | Treatment amount (mass %) | Treatment agent 2 | Treatment amount (mass %) | Physical properties of inorganic fine particles: Number average particle diameter of primary particles (nm) | Dielectric constant (25° C., 1 MHz) (pF/m) |
|---|---|---|---|---|---|---|
| 15 | 1-6 | 2.0 | — | — | 90 | 100.0 |
| 16 | 1-5 | 2.0 | — | — | 110 | 110.0 |

Symbols in the table are as follows.

(Treatment Agent 1)

1-1: n-octyltriethoxysilane 1-2: isobutyltrimethoxysilane 1-3: decyltrimethoxysilane 1-4: dodecyltrimethoxysilane 1-5: octadecyltrimethoxysilane 1-6: octadecyldimethoxysilane (Treatment Agent 2)

2-1: 3,3,3-trifluoropropyltrimethoxysilane

Production Example of Titanium Oxide Fine Particles 1

An ilmenite mineral ore containing 50 mass % equivalent of $TiO_2$ was used as a starting material. An aqueous solution of $TiOSO_2$ was obtaining by drying this starting material for 2 hours at a temperature of 150° C. and then adding sulfuric acid to dissolve the starting material. A white precipitate was obtained by adding sodium carbonate to this aqueous solution so as to adjust the pH to 9.0, neutralizing with an alkali, and then filtering.

Anatase titanium oxide was obtained by adding pure water to this white precipitate, heat treating for 2.5 hours while maintaining a temperature of approximately 90° C., carrying out hydrolysis, and repeatedly filtering and washing with water.

Rutile titanium oxide was obtained by heating and sintering the obtained anatase titanium oxide at a high temperature of 1100° C. Titanium oxide fine particles were obtained by crushing this rutile titanium oxide using a jet mill.

These titanium oxide fine particles were dispersed in ethanol, 2 parts in terms of solid content of n-octyltriethoxysilane as a hydrophobizing agent were added dropwise to 100 parts of the titanium oxide fine particles while thoroughly stirring so that particles did not coalesce, and a reaction was allowed to occur so as to effect hydrophobization.

The pH of the slurry was adjusted to 6.5 under further thorough stirring. Titanium oxide fine particles 1 were obtained by filtering and drying the slurry, heat treating for 2 hours at a temperature of 170° C., and then repeatedly crushing until aggregates of the titanium oxide fine particles disappeared.

The obtained titanium oxide fine particles 1 had a dielectric constant of 51.0 pF/m and a number average particle diameter of primary particles of 15 nm.

Production Example of Silica Fine Particles 1

Silica fine particles were obtained by supplying oxygen gas to a burner, lighting an ignition burner, supplying hydrogen gas to the burner to form a flame, and introducing silicon tetrachloride, which is a raw material, to the flame to gasify the silicon tetrachloride. The obtained silica fine particles were transferred to an electric furnace, spread in the form of a thin layer, and then sintered by being heat treated at 900° C. Specifically, the method disclosed in Japanese Patent Application Publication No. 2002-3213 was used.

These silica fine particles were dispersed in ethanol, 2 parts in terms of solid content of n-octyltriethoxysilane as a hydrophobizing agent were added dropwise to 100 parts of the silica fine particles while thoroughly stirring so that particles did not coalesce, and a reaction was allowed to occur so as to effect hydrophobization.

The pH of the slurry was adjusted to 6.5 under further thorough stirring. Silica fine particles 1 were obtained by filtering and drying the slurry, heat treating for 2 hours at a temperature of 170° C., and then repeatedly crushing until aggregates of the silica fine particles disappeared.

The obtained silica fine particles 1 had a dielectric constant of 2.0 pF/m and a number average particle diameter of primary particles of 10 nm.

Production Example of Binder Resin 1

Adduct of (2.2 moles of) ethylene oxide to bisphenol A: 40.0 parts by mole

Adduct of (2.2 moles of) propylene oxide to bisphenol A: 40.0 parts by mole

Ethylene glycol: 20.0 parts by mole

Terephthalic acid: 100.0 parts by mole

In a 5 liter autoclave, the monomers listed above were supplied at a quantity of 95.0 mass % relative to the overall quantity of monomers that constitute the polyester structure, an aliphatic monoalcohol having an average number of carbon atoms of 50 (a primary monoalcohol wax which has a hydroxyl group at one polyethylene terminal and in which the average number of carbon atoms in the alkyl group is 50) was supplied at a quantity of 5.0 mass % relative to the overall quantity of monomers that constitute the polyester structure and titanium tetrabutoxide was supplied at a quantity of 0.2 parts relative to a total of 100 parts of monomers that constitute the polyester structure.

A reflux condenser, a moisture separator, a $N_2$ gas inlet tube, a temperature gauge and a stirrer were attached to the autoclave, and a polycondensation reaction was carried out at 230° C. while introducing $N_2$ gas into the autoclave.

Moreover, the reaction time was adjusted so as to achieve a softening point of 95° C. Following completion of the reaction, binder resin 1 was obtained by removing the obtained resin from the container and then cooling and pulverizing the resin. Binder resin 1 had a softening point of 95° C.

Production Examples of Binder Resins 2 and 3

Binder resins 2 and 3 were obtained in the same way as in the production example of binder resin 1, except that the type of aliphatic compound and the added quantity (mass %) of the aliphatic compound relative to the overall quantity of monomers that constitute the polyester structure were changed to those shown in Table 2 and the reaction time was adjusted in order to achieve a softening point of 140° C. Physical properties of binder resins 2 and 3 are shown in Table 2.

Production Example of Binder Resin 4

Adduct of (2.2 moles of) ethylene oxide to bisphenol A: 50.0 parts by mole

Adduct of (2.2 moles of) propylene oxide to bisphenol A: 50.0 parts by mole

Terephthalic acid: 100.0 parts by mole

In a 5 liter autoclave, the monomers listed above were supplied at a quantity of 94.0 mass % relative to the overall quantity of monomers that constitute the polyester structure, an aliphatic monoalcohol having an average of 60 carbon atoms (a primary monoalcohol wax which has a hydroxyl group at one polyethylene terminal and in which the average number of carbon atoms in the alkyl group is 60) was supplied at a quantity of 6.0 mass % relative to the overall quantity of monomers that constitute the polyester structure and titanium tetrabutoxide was supplied at a quantity of 0.2 parts relative to a total of 100 parts of monomers that constitute the polyester structure.

A reflux condenser, a moisture separator, a $N_2$ gas inlet tube, a temperature gauge and a stirrer were attached to the autoclave, and a polycondensation reaction was carried out at 230° C. while introducing $N_2$ gas into the autoclave.

Moreover, the reaction time was adjusted so as to achieve a softening point of 140° C. Following completion of the reaction, binder resin 4 was obtained by removing the obtained resin from the container and then cooling and pulverizing the resin. Binder resin 4 had a softening point of 140° C.

Production Examples of Binder Resins 5 to 7

Binder resins 5 to 7 were obtained in the same way as in the production example of binder resin 4, except that the type of aliphatic compound and the added quantity (mass %) of the aliphatic compound relative to the overall quantity of monomers that constitute the polyester structure were changed to those shown in Table 2. Physical properties of binder resins 5 to 7 are shown in Table 2.

Production Example of Binder Resin 8

Styrene: 90.0 parts by mole

Dodecyl methacrylate: 10.0 parts by mole 5 parts of benzoyl peroxide were added as a polymerization initiator to 100 parts of the monomers listed above, and xylene was added dropwise over a period of 4 hours. Polymerization was then carried out under xylene refluxing until a softening point of 140° C. was achieved. Binder resin 8 was then obtained by increasing the temperature so as to distil off the organic solvent, cooling to room temperature, and then pulverizing. Binder resin 8 had a softening point of 140° C.

Production Example of Binder Resin 9

Adduct of (2.2 moles of) ethylene oxide to bisphenol A: 40.0 parts by mole

Adduct of (2.2 moles of) propylene oxide to bisphenol A: 40.0 parts by mole

Ethylene glycol: 20.0 parts by mole

Terephthalic acid: 100.0 parts by mole 100 parts of the monomers listed above and 0.2 parts of titanium tetrabutoxide were supplied to a 5 liter autoclave. A reflux condenser, a moisture separator, a $N_2$ gas inlet tube, a temperature gauge and a stirrer were attached to the autoclave, and a polycondensation reaction was carried out at 230° C. while introducing $N_2$ gas into the autoclave. Moreover, the reaction time was adjusted so as to achieve a softening point of 140° C. Following completion of the reaction, binder resin 9 was obtained by removing a resin from the container and then cooling and pulverizing the resin. Binder resin 9 had a softening point of 140° C.

Production Example of Binder Resin 10

Formulation of Polyester Structural Moiety

Adduct of (2.2 moles of) ethylene oxide to bisphenol A: 100.0 parts by mole

Terephthalic acid: 65.0 parts by mole

Trimellitic anhydride: 25.0 parts by mole

Acrylic acid: 10.0 parts by mole 75 parts of the above-mentioned mixture of monomers that constitutes the polyester structure and 5 parts of an aliphatic monoalcohol having an average number of carbon atoms of 36 (a secondary monoalcohol which has a hydroxyl group in a paraffin wax and in which the average number of carbon atoms in the alkyl group is 36) were supplied to a four-mouthed flask, a depressurization device, a water separation device, a nitrogen gas introduction device, a temperature measurement device and a stirring device were fitted to the flask, and the contents of the flask were stirred at 160° C. in a nitrogen atmosphere.

Next, 20 parts of vinyl monomers that constitute the vinyl-based copolymer (90.0 parts by mole of styrene and 10.0 parts by mole of 2-ethylhexyl acrylate) and 1 part of benzoyl peroxide as a polymerization initiator were added dropwise from a dropping funnel over a period of 4 hours, and a reaction was carried out for 5 hours at 160° C.

The temperature was then increased to 230° C., titanium tetrabutoxide was added at a quantity of 0.2 parts relative to a total of 100 parts of the monomers that constitute the polyester structure, and a polymerization reaction was carried out until a softening point of 150° C. was achieved. Following completion of the reaction, binder resin 10 was obtained by removing the obtained resin from the container and then cooling and pulverizing the resin. Binder resin 10 had a softening point of 150° C.

TABLE 2

| Binder resin No. | Softening point (° C.) | Glass transition temperature (° C.) | Type of resin | Aliphatic compound | Average number of carbon atoms in alkyl group | Content of aliphatic compound (mass %) |
|---|---|---|---|---|---|---|
| 1 | 95 | 57 | Polyester | Aliphatic monoalcohol | 50 | 5.0 |
| 2 | 140 | 60 | Polyester | Aliphatic monoalcohol | 34 | 1.0 |
| 3 | 140 | 60 | Polyester | Aliphatic monoalcohol | 60 | 6.0 |
| 4 | 140 | 60 | Polyester | Aliphatic monocarboxylic acid | 60 | 6.0 |
| 5 | 140 | 60 | Polyester | Aliphatic monocarboxylic acid | 32 | 10.0 |
| 6 | 140 | 60 | Polyester | Aliphatic monocarboxylic acid | 80 | 0.1 |
| 7 | 140 | 60 | Polyester | Aliphatic monocarboxylic acid | 102 | 11.0 |
| 8 | 140 | 60 | Styrene acrylic | — | — | — |
| 9 | 140 | 60 | Polyester | — | — | — |
| 10 | 150 | 62 | Hybrid | Aliphatic monoalcohol | 36 | 5.0 |

Example 1

Production Example of Toner 1

Binder resin 1: 50 parts
Binder resin 10: 50 parts
Fischer Tropsch wax: 5 parts
(Melting point: 105° C.)
Magnetic iron oxide particles: 90 parts
(Number average particle diameter=0.20 μm, Hc (coercive force)=10 kA/m, σs (saturation magnetization)=83 $Am^2/kg$, σr (residual magnetization)=13 $Am^2/kg$)
Aluminum 3,5-di-tert-butylsalicylate compound: 1 part The materials listed above were mixed using a Henschel mixer and then melt kneaded using a twin screw kneading extruder. The obtained kneaded product was cooled and coarsely pulverized using a hammer mill.

The coarsely pulverized product was then pulverized using a jet mill, and the obtained finely pulverized product was classified using a multiple section sorting apparatus using the Coanda effect, thereby obtaining negative triboelectric charge type toner particles having a weight average particle diameter (D4) of 6.8 μm.

0.5 parts of inorganic fine particles 1 and 2.0 parts of hydrophobically treated silica fine particles (which had a nitrogen adsorption specific surface area of 140 $m^2/g$, as measured using the BET method) were externally added to, and mixed with, 100 parts of the toner particles.

In order to control the particle size distribution of the inorganic fine particles at the surface of the toner particle, the external addition and mixing was carried out by regulating the temperature and flow rate of cooling water supplied to the treatment device while monitoring the temperature inside the tank of the mixer, and regulating so that the temperature inside the tank of the mixer was 45° C.

Toner 1 was obtained by sieving through a mesh having an opening size of 150 μm. The formulation of toner 1 is shown in Table 3.

Toner 1 was evaluated using an evaluation device obtained by modifying a commercially available digital copier (an image RUNNER ADVANCE 8105 PRO available from Canon, Inc.) to a processing speed of 700 mm/s. Evaluation details are as shown below.

Evaluation of Scratch Abrasion Resistance (Evaluation 1)

Scratch abrasion resistance was evaluated by outputting a whole page solid image at a toner laid-on level of 0.8 $mg/cm^2$ (a case in which a toner image is formed on the entire surface of an image-formable region of a photosensitive drum, and the image ratio (print percentage) is 100%) in a low temperature low humidity environment (L/L: 5° C., 5% RH), and evaluating the obtained image in the manner described below. The evaluation paper was SPLENDORLUX (135.0 $g/m^2$ paper).

Measuring device: HEIDON tribology tester
Test needle: Diameter 0.075 mm
Measurement conditions: 60 mm/min, 30 mm, 20 gf load The scratch abrasion of the whole page solid image was evaluated under the conditions mentioned above.

Evaluation Criteria
A: No scratch abrasion
B: Very slight scratch abrasion observed, but of little concern
C: Slight scratch abrasion observed
D: Scratch abrasion could be confirmed
E: Scratch abrasion very noticeable Evaluation of Half Tone Uniformity (Evaluation 2)

Half tone uniformity was evaluated by outputting a two-dot three-space half tone image at a resolution of 600 dpi in a low temperature low humidity (L/L: 5° C., 5% RH) environment, and visually evaluating the half tone image quality (density non-uniformity in development) of the obtained image.

The evaluation paper was CS-520 (52.0 $g/m^2$ paper, A4 size, purchased from Canon Marketing Japan Inc.), and the evaluation paper was used after being left in a high temperature high humidity (H/H: 30° C., 80% RH) environment for 48 hours or more so that the paper was thoroughly moistened.

Evaluation Criteria
A: No density non-uniformity experienced
B: Very slight density non-uniformity observed, but of little concern
C: Slight density non-uniformity observed D: Density non-uniformity could be confirmed
E: Density non-uniformity very noticeable Evaluation of Hot Offset Resistance (Evaluation 3)

This evaluation was carried out using a modified external fixing unit obtained by removing the fixing unit from an "image RUNNER ADVANCE 8105 PRO" (trade name) digital electrophotographic machine available from Canon, Inc. so that the fixing unit could be operated outside of the machine and the fixation temperature and process speed could be arbitrarily set. Using this external fixing unit, paper was fed in a high temperature high humidity (H/H: 30° C., 80% RH) environment.

Hot offset resistance was evaluated by using paper having a basis weight of 50 g/m$^2$, creating an unfixed image in which an entire region measuring 5 cm from the edges of an A4 landscape-oriented paper was half tone having an image density of 0.5 (the image density is a value obtained using an X-Rite color reflection densitometer (X-Rite 500 Series available from X-Rite)) and the rest of the paper was solid white, and then feeding paper using the following method.

The temperature of the heating unit in the external fixing unit was adjusted at 5° C. intervals within the temperature range from 210° C. to 240° C., the process speed was set to 50 mm/sec, the nip width was set to 13 mm, 100 sheets of A5 size paper (having a basis weight of 50 g/m$^2$) having nothing printed thereon were fed, and the A4 landscape-oriented unfixed image prepared above was fed and fixed. At this point, the level of offsetting occurring on white background parts of the A4 landscape-oriented image was confirmed visually.

A: Absolutely no offsetting occurred.
B: Slight offsetting occurred at edges of white background parts on an A4 landscape-oriented image at a fixation temperature of 240° C.
C: Slight offsetting occurred at edges of white background parts on an A4 landscape-oriented image at a fixation temperature of 230° C.
D: Slight offsetting occurred at edges of white background parts on an A4 landscape-oriented image at a fixation temperature of 220° C.
E: Slight offsetting occurred at edges of white background parts on an A4 landscape-oriented image at a fixation temperature of 210° C. or lower.

Evaluation of Image Density (Evaluation 4)

This evaluation was carried out after continuously feeding 10 test charts having a print coverage rate of 5% in a variety of environments [a normal temperature normal humidity (N/N: 23° C., 55% RH) environment, a high temperature high humidity (H/H: 30° C., 80% RH) environment and a low temperature low humidity (L/L: 5° C., 5% RH) environment].

The evaluation paper was CS-680 (68.0 g/m$^2$, A4, sold by Canon Marketing Japan K.K.).

In this evaluation method, an original image was outputted in such a way that solid black patches measuring 20 mm on each side were disposed at five locations within a development region, and the average density at these five points was taken to be the image density.

Moreover, in which density was measured using an X-Rite color reflection densitometer (X-Rite 500 Series available from X-Rite).

Evaluation Criteria
A: Image density of not less than 1.45
B: Image density of not less than 1.40 but less than 1.45
C: Image density of not less than 1.35 but less than 1.40
D: Image density of not less than 1.30 but less than 1.35
E: Image density of less than 1.30

Evaluation of Fogging (Evaluation 5)

Fogging was evaluated after continuously feeding 10 test charts having a print coverage rate of 5% in a variety of environments [a normal temperature normal humidity (23° C., 55% RH) environment, a high temperature high humidity (30° C., 80% RH) environment and a low temperature low humidity (5° C., 5% RH) environment].

In this evaluation method, a solid white image was evaluated using the criteria below.

Moreover, measurements were carried out using a reflectance meter (a TC-6DS model reflectometer available from Tokyo Denshoku Co., Ltd.), and fogging was evaluated using the value of Dr-Ds as the amount of fogging, where Ds denotes the worst value of reflection density on white background parts following image formation, and Dr denotes the average reflection density on the media prior to image formation. Therefore, a lower value means that less fogging occurs.

Evaluation Criteria
A: Fogging of less than 1.0
B: Fogging of not less than 1.0 but less than 2.0
C: Fogging of not less than 2.0 but less than 3.0
D: Fogging of not less than 3.0 but less than 4.0
E: Fogging of not less than 4.0

Production Examples of Toners 2 to 18

Toners 2 to 18 were obtained in the same way as in the production example 1, except that the type of binder resin, the type and added quantity (parts) of the inorganic fine particles and the temperature inside the tank of the mixer during the external addition and mixing were changed to those shown in Table 3.

TABLE 3

| Toner No. | Binder resin No. | | Inorganic fine particles No. | Inorganic fine particles Added quantity | Temperature inside tank (° C.) | Inorganic fine particles at toner surface: Particle diameter (number-based: nm) D90 | D50 | D10 | Particle size distribution index A D90/D10 |
|---|---|---|---|---|---|---|---|---|---|
| 1 | 1 | 10 | 1 | 0.5 | 45 | 95 | 55 | 38 | 2.50 |
| 2 | 1 | 10 | 2 | 0.5 | 45 | 95 | 55 | 38 | 2.50 |
| 3 | 1 | 10 | 3 | 0.5 | 45 | 95 | 55 | 38 | 2.50 |
| 4 | 2 | — | 4 | 1.5 | 45 | 145 | 85 | 54 | 2.69 |
| 5 | 3 | — | 5 | 0.1 | 45 | 50 | 30 | 20 | 2.50 |

TABLE 3-continued

| Toner No. | Binder resin No. | | Inorganic fine particles No. | Inorganic fine particles Added quantity | Temperature inside tank (° C.) | Inorganic fine particles at toner surface: Particle diameter (number-based: nm) D90 | D50 | D10 | Particle size distribution index A D90/D10 |
|---|---|---|---|---|---|---|---|---|---|
| 6 | 4 | — | 5 | 0.1 | 45 | 50 | 30 | 20 | 2.50 |
| 7 | 4 | — | 6 | 0.1 | 45 | 145 | 40 | 18 | 8.06 |
| 8 | 4 | — | 7 | 0.1 | 45 | 138 | 88 | 66 | 2.09 |
| 9 | 4 | — | 8 | 0.1 | 45 | 23 | 15 | 11 | 2.09 |
| 10 | 4 | — | 9 | 0.1 | 35 | 100 | 92 | 80 | 1.25 |
| 11 | 4 | — | 10 | 0.1 | 35 | 100 | 60 | 7 | 14.29 |
| 12 | 4 | — | 11 | 0.1 | 35 | 100 | 60 | 7 | 14.29 |
| 13 | 4 | — | 11 | 2.0 | 35 | 100 | 60 | 7 | 14.29 |
| 14 | 4 | — | 12 | 2.0 | 35 | 100 | 60 | 7 | 14.29 |
| 15 | 5 | — | 13 | 2.0 | 35 | 100 | 60 | 7 | 14.29 |
| 16 | 6 | — | 13 | 15.0 | 35 | 100 | 60 | 7 | 14.29 |
| 17 | 6 | — | 14 | 20.0 | 35 | 100 | 60 | 7 | 14.29 |
| 18 | 7 | — | 14 | 20.0 | 35 | 100 | 60 | 7 | 14.29 |

Examples 2 to 18

Toners 2 to 18 were evaluated using the same methods as those used in Example 1. The evaluation results are shown in Table 4.

TABLE 4

| | Toner No. | Evaluation No. 1 | 2 | 3 | 4 (N/N) | 4 (L/L) | 4 (H/H) | 5 (N/N) | 5 (L/L) | 5 (H/H) |
|---|---|---|---|---|---|---|---|---|---|---|
| Example 1 | 1 | A | A | A | A(1.48) | A(1.48) | A(1.48) | A(0.10) | A(0.10) | A(0.10) |
| Example 2 | 1 | A | A | A | A(1.48) | A(1.48) | A(1.48) | A(0.10) | A(0.10) | A(0.10) |
| Example 3 | 1 | A | A | A | A(1.48) | A(1.48) | A(1.48) | A(0.10) | A(0.10) | A(0.10) |
| Example 4 | 2 | A | A | B | A(1.48) | A(1.48) | A(1.48) | A(0.20) | A(0.20) | A(0.10) |
| Example 5 | 3 | A | A | B | A(1.48) | A(1.48) | A(1.48) | A(0.20) | A(0.20) | A(0.10) |
| Example 6 | 4 | B | A | B | A(1.48) | A(1.48) | A(1.47) | A(0.30) | A(0.30) | A(0.20) |
| Example 7 | 5 | B | B | B | A(1.48) | A(1.48) | A(1.47) | A(0.30) | A(0.30) | A(0.20) |
| Example 8 | 6 | C | B | B | A(1.48) | A(1.48) | A(1.47) | A(0.30) | A(0.30) | A(0.20) |
| Example 9 | 7 | C | B | B | A(1.47) | A(1.47) | A(1.47) | A(0.30) | A(0.30) | A(0.20) |
| Example 10 | 8 | C | C | B | A(1.47) | A(1.47) | A(1.47) | A(0.30) | A(0.30) | A(0.20) |
| Example 11 | 9 | C | C | B | A(1.47) | A(1.47) | A(1.46) | A(0.30) | A(0.30) | A(0.30) |
| Example 12 | 10 | C | C | B | A(1.47) | A(1.47) | A(1.46) | A(0.30) | A(0.30) | A(0.30) |
| Example 13 | 11 | C | C | C | A(1.46) | A(1.46) | A(1.46) | A(0.40) | A(0.40) | A(0.30) |
| Example 14 | 12 | C | C | D | A(1.46) | A(1.46) | A(1.46) | A(0.40) | A(0.40) | A(0.30) |
| Example 15 | 13 | D | C | D | A(1.46) | A(1.46) | A(1.46) | A(0.40) | A(0.40) | A(0.30) |
| Example 16 | 14 | D | C | D | A(1.46) | A(1.46) | A(1.46) | A(0.40) | A(0.40) | A(0.30) |
| Example 17 | 15 | D | D | D | A(1.46) | A(1.46) | A(1.45) | A(0.40) | A(0.40) | A(0.30) |
| Example 18 | 16 | D | D | D | A(1.46) | A(1.46) | A(1.45) | A(0.40) | A(0.40) | A(0.30) |

Production Examples of Toners 19 to 24

Toners 19 to 24 were obtained in the same way as in the production example 1, except that the type of binder resin, the type and added quantity (parts) of the inorganic fine particles and the temperature inside the tank of the mixer during the external addition and mixing were changed to those shown in Table 5.

TABLE 5

| Toner No. | Binder resin No. | | Inorganic fine particles No. | Inorganic fine particles Added quantity | Temperature inside tank (° C.) | Inorganic fine particles at toner surface: Particle diameter (number-based: nm) D90 | D50 | D10 | Particle size distribution index A D90/D10 |
|---|---|---|---|---|---|---|---|---|---|
| 19 | 8 | — | 13 | 15.0 | 35 | 100 | 60 | 7 | 14.29 |
| 20 | 9 | — | 13 | 15.0 | 35 | 100 | 60 | 7 | 14.29 |
| 21 | 7 | — | A | 0.1 | 45 | 25 | 17 | 11 | 2.27 |
| 22 | 7 | — | B | 0.1 | 45 | 23 | 15 | 11 | 2.09 |
| 23 | 7 | — | 15 | 15.0 | 35 | 100 | 60 | 7 | 14.29 |
| 24 | 7 | — | 16 | 15.0 | 35 | 100 | 60 | 7 | 14.29 |

In the table, A denotes titanium oxide fine particles 1 and B denotes silica fine particles 1.

Comparative Examples 1 to 6

Toners 19 to 24 were evaluated using the same methods as those used in Example 1. The evaluation results are shown in Table 6.

TABLE 6

| | Toner No. | Evaluation No. 1 | 2 | 3 | 4 (N/N) | 4 (L/L) | 4 (H/H) | 5 (N/N) | 5 (L/L) | 5 (H/H) |
|---|---|---|---|---|---|---|---|---|---|---|
| Comparative example 1 | 19 | E | E | E | A(1.45) | A(1.47) | A(1.46) | A(0.8) | A(0.9) | A(0.9) |
| Comparative example 2 | 20 | E | E | E | A(1.45) | A(1.47) | A(1.46) | A(0.8) | A(0.8) | A(0.7) |
| Comparative example 3 | 21 | E | E | E | A(1.45) | A(1.47) | A(1.46) | A(0.9) | A(0.9) | A(0.8) |
| Comparative example 4 | 22 | E | E | E | A(1.45) | A(1.47) | A(1.46) | A(0.9) | A(0.9) | A(0.8) |
| Comparative example 5 | 23 | E | E | E | A(1.45) | A(1.47) | A(1.46) | A(0.9) | A(0.9) | A(0.8) |
| Comparative example 6 | 24 | E | E | E | A(1.45) | A(1.47) | A(1.46) | A(0.9) | A(0.9) | A(0.8) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-159407, filed Aug. 28, 2018, which is hereby incorporated by reference herein in its entirety.

What is claimed is:

1. A toner having a toner particle which contains a binder resin, and inorganic fine particles, wherein the binder resin contains a polyester resin, the polyester resin has, at a terminal, an alkyl group having an average number of carbon atoms of from 4 to 102, a number average particle diameter of primary particles of the inorganic fine particles is from 10 to 90 nm, a dielectric constant of the inorganic fine particles is from 55.0 to 100.0 pF/m, as measured at 25° C. and 1 MHz, and the inorganic fine particles are surface-treated with an alkylalkoxysilane represented by the following formula (1):

$$C_nH_{2n+1}—Si-(-OC_mH_{2m+1})_3 \quad (1)$$

wherein, n denotes an integer of from 4 to 20, and m denotes an integer of from 1 to 3.

2. The toner according to claim 1, wherein the inorganic fine particles are contained in an amount of from 0.1 to 15.0 parts by mass relative to 100 parts by mass of the toner particle.

3. The toner according to claim 1, wherein the inorganic fine particles have a crystal structure, the crystal structure being a perovskite structure.

4. The toner according to claim 1, wherein the inorganic fine particles are strontium titanate particles.

5. The toner according to claim 1, wherein in a number-based particle size distribution of the inorganic fine particles at the surface of the toner particle, when D10 denotes a particle diameter at which a cumulative value from the small particle diameter side reaches 10 number %, and D90 denotes a particle diameter at which a cumulative value from the small particle diameter side reaches 90 number %, a particle size distribution index A, which is expressed by the ratio of D90 to D10 (D90/D10), is from 2.00 to 10.00.

* * * * *